US012588757B2

(12) United States Patent
Guerinoni

(10) Patent No.: US 12,588,757 B2
(45) Date of Patent: Mar. 31, 2026

(54) TRANSPORTABLE, STORABLE, MODIFIABLE, COLLAPSIBLE, MODULAR, BALL RACK

(71) Applicant: DKG Athletic Innovations LLC, Wayland, MA (US)

(72) Inventor: Donald J Guerinoni, Wayland, MA (US)

(73) Assignee: DKG Athletic Innovations LLC, Wayland, MA (US)

( * ) Notice: Subject to any disclaimer, the term of this patent is extended or adjusted under 35 U.S.C. 154(b) by 0 days.

(21) Appl. No.: 18/787,503

(22) Filed: Jul. 29, 2024

(65) Prior Publication Data

US 2025/0031846 A1 Jan. 30, 2025

Related U.S. Application Data

(60) Provisional application No. 63/529,200, filed on Jul. 27, 2023.

(51) Int. Cl.

| | |
|---|---|
| ***A47B 81/00*** | (2006.01) |
| ***A47B 43/00*** | (2006.01) |
| ***A47B 45/00*** | (2006.01) |
| ***A47F 5/10*** | (2006.01) |

(52) U.S. Cl.

CPC ..... *A47B 81/00* (2013.01); *A47B 43/00* (2013.01); *A47B 45/00* (2013.01); *A47F 5/108* (2013.01)

(58) Field of Classification Search

CPC ..... A47B 81/00; A47B 43/00; A47B 45/00; A47B 47/0083; A47F 5/10; A47F 5/108; B62B 1/04; B62B 1/042

USPC .... 211/85.7, 175, 195, 149, 204, 14, 27, 37; 280/7.3, 639, 79.3

See application file for complete search history.

(56) References Cited

U.S. PATENT DOCUMENTS

| | | | | | |
|---|---|---|---|---|---|
| 1,390,123 | A | * | 9/1921 | Gilkey | B62B 3/02 280/35 |
| 1,733,487 | A | * | 10/1929 | Hackley | A47B 61/04 211/35 |
| 2,276,141 | A | * | 3/1942 | Atkinson | A47L 23/20 211/37 |
| 2,805,776 | A | * | 9/1957 | Levitin | A47F 7/30 248/172 |
| 2,885,090 | A | * | 5/1959 | Forman | A47F 7/24 211/175 |
| 3,355,027 | A | * | 11/1967 | Gibbons | A63B 47/00 190/18 R |
| 3,861,695 | A | * | 1/1975 | Shourek | B62B 1/125 211/195 |

(Continued)

FOREIGN PATENT DOCUMENTS

| | | | |
|---|---|---|---|
| CN | 2933499 | Y | 5/2006 |
| CN | 206745932 | U | 4/2017 |

(Continued)

*Primary Examiner* — Jennifer E. Novosad
(74) *Attorney, Agent, or Firm* — Bay State IP, LLC

(57) ABSTRACT

A ball rack including a main base frame configured to maintain a substantially rectangular shape, the main base frame including a set of short members, a set of long members having telescoping features to allow variation in width using a pin and hole mechanism, a set of wheeled accessories, a set of vertical frame bars, a set of telescoping detachable horizontal rack beams and a set of frame bars.

9 Claims, 33 Drawing Sheets

(56) References Cited

U.S. PATENT DOCUMENTS 3,888,353 A * 6/1975 Leifheit ..... A47B 61/04 211/37
3,918,591 A * 11/1975 Cooper ..... A47F 5/108 211/204
4,896,778 A * 1/1990 Ferdinand ..... A47F 7/08 D6/672
5,439,152 A * 8/1995 Campbell ..... B60R 9/00 211/195
D365,716 S * 1/1996 Rose, Sr. ..... D6/552
5,660,637 A * 8/1997 Dodge ..... B05B 13/0285 211/208
5,816,604 A * 10/1998 Hsieh ..... B62B 3/02 280/33.997
D403,880 S * 1/1999 Malik ..... D6/681.1
D405,578 S * 2/1999 Shumake ..... D34/17
5,941,398 A * 8/1999 Harris ..... A47B 43/00 211/49.1
5,992,647 A * 11/1999 Malik ..... G11B 23/0236 211/40
6,279,763 B1 * 8/2001 Bush ..... B65D 88/522 211/85.5
D457,767 S * 5/2002 Schumacher ..... D6/552
6,422,405 B1 * 7/2002 Haenszel ..... B65D 85/68 211/208
6,766,730 B2 * 7/2004 Wrenn ..... A47J 37/041 99/449
6,883,670 B2 * 4/2005 Moon ..... A47F 3/002 211/74
6,966,574 B1 * 11/2005 Dahl ..... B62B 1/12 280/651
7,000,787 B2 * 2/2006 Felsenthal ..... A47F 5/137 211/175
7,249,679 B2 * 7/2007 Klein ..... A47F 7/08 211/175
7,490,847 B2 * 2/2009 Dahl ..... B60B 33/0073 280/654
D602,716 S * 10/2009 Klein ..... D6/703.1
7,731,221 B2 * 6/2010 Bess ..... B62B 3/02 280/30
7,878,345 B2 * 2/2011 Tourlamain ..... B65D 19/12 211/195
8,714,369 B2 * 5/2014 Liu ..... A47F 7/30 211/175
8,900,074 B1 * 12/2014 Johnson ..... A63B 63/00 473/422
9,420,881 B2 8/2016 Reid et al.
D1,006,377 S * 11/2023 Jiang ..... D34/12
2009/0266777 A1 * 10/2009 Porter, Sr. ..... A47F 5/137 211/85.7
2010/0117499 A1 5/2010 Fortier
2012/0235386 A1 * 9/2012 Grundvig ..... B62B 3/02 280/651
2022/0212063 A1 7/2022 Bovell
2025/0031846 A1 * 1/2025 Guerinoni ..... A47B 43/00

FOREIGN PATENT DOCUMENTS

CN 208248737 U 5/2018
CN 210521714 U 7/2019
CN 210495153 U 8/2019
CN 211795067 U 1/2020
CN 213724761 U 8/2021
CN 217199209 3/2022
CN 217697867 U 6/2022
CN 218164578 U 6/2022
CN 218432270 U 10/2022

* cited by examiner

TRANSPORTABLE, STORABLE, MODIFIABLE, COLLAPSIBLE, MODULAR, BALL RACK

CROSS REFERENCE TO RELATED APPLICATION

This application claims the benefit of and takes priority from U.S. Provisional Patent Application Ser. No. 63/529,200 filed on Jul. 27, 2023, the contents of which are incorporated herein by reference.

BACKGROUND OF THE INVENTION

Field of the Invention

The present invention relates to a ball rack, and particularly to a transportable, storable, modifiable, collapsible, modular, ball rack with a main base frame, upright vertical frame bars, and detachable horizontal rack beams which accommodate at least one type of sports equipment.

Description of the Related Art

Many people enjoy exercise and physical activity, especially sports. Such activities promote health and general well-being. While the general populace may enjoy participating in sports to one degree or another, their participation is generally perfunctory and performed more as a form of exercise and/or group activity. For others, the individual's sport of choice is a more serious and competitive activity where they try to master the skills, strategies, and nuances necessary to compete and excel. In such a case, the capacity to compete on this level requires a strong commitment, continued effort and any systems and/or mechanisms that may further the effort.

Whatever the level of commitment or effort, the participant must maximize their physical conditioning and hone their skills in order to maximize their chances of success through training and numerous practice sessions. Each sport generally includes its own unique set of challenges and specialized set of maneuvers and skills to counter those challenges.

For example, in basketball, players must learn to effectively shoot so that the basketball arcs over the vertically outstretched arms of an opponent. Such results can be seen in any level of play where the proficient player will shoot so that the basketball travels in a high parabolic arc towards the hoop, the high arc intended to overcome the opponent's attempts to block. In U.S. football, players must learn to tackle and to juke around opponents who may be in the way of the player trying to reach the first down marker or get into the end zone for a touchdown. In U.S. soccer or international football, players must practice and train their accuracy in kicking the ball into the net or improve their agility to maneuver around opponents using their feet.

Each of the above examples can be practiced on the field or basketball court with other players, but specialized sports training devices have been developed to assist training these skills without requiring another player to represent the opponent. Some examples of sports training equipment include tackle shields and sleds (football), hurdles (track and soccer), training sticks or poles (soccer), catch nets (for various sports), ball pitching machines (e.g., tennis and baseball), defensive mannequins (basketball), and the like. While these training devices are suitable for training the player in a certain area or skill of a sport, most tend to be expensive and specialized. The expenses associated therewith can be prohibitive to some sports programs with limited finances.

The specialized nature of such equipment often also severely limits versatility, since it would not be functional across multiple sports. Moreover, if players or users desire to train multiple skills, such considerations would require acquisition of a plurality of specialized training devices covering a wide range of skills, which results in more equipment to tote and store.

Additionally, some training devices can be difficult to transport and/or assemble/disassemble. Specifically, existing ball racks cannot be broken down, making them unwieldy to transport and requiring significant storage space when they are not in use. Coaches and teams that travel often find themselves without racks since they cannot bring existing options with them on the road. This leaves them without an important tool that is crucial for having an organized practice.

SUMMARY OF THE INVENTION

The instant apparatus and system, as illustrated herein, is clearly not anticipated, rendered obvious, or even present in any of the prior art mechanisms, either alone or in any combination thereof. A versatile system, method, and series of apparatuses for creating and utilizing a transportable, storable, modifiable, collapsible, modular, ball rack and other like systems is disclosed.

It is an object of the present system to provide a ball rack and foldable training and coaching apparatus design to be easily transportable to a site and assembled and disassembled without the need of tools and the placement or removal of screws and bolts. The ball rack includes detachable horizontal rack beams with telescoping features and upright vertical frame bars, where the upright vertical frame bars connect to a main base frame with wheel accessories. The main base frame has at least two upright vertical frame bars which extend from the main base.

The upright vertical frame bars may further utilize a hinge mechanism at the lower portion of the upright vertical frame bars which connects to the main base frame and adjusts the structure into a storage mode and a portable cart mode. The hinge mechanism further comprises a spring locking mechanism which locks the vertical frame bars in place.

It is an object of the present system to provide a system comprising detachable horizontal rack beams placed symmetrically at the front and back of the ball rack and that can be adjusted to a desired width with a telescoping mechanism and held in place with a pin and hole locking mechanism. The detachable horizontal rack beams are held in place perpendicular to the upright vertical frame bars with a hook and lock mechanism on each end of the detachable horizontal rack beams.

The hook and lock mechanism utilizes a hook at each end of the detachable horizontal rack beams disposed to fit into a vertical slot in the upright vertical frame bars and hold the detachable horizontal rack beams into place. When assembled, the components form a framework to which sports equipment can be mounted. The ball rack can likewise be transitioned into a cart or a dolly/storage mode, or disassembled and prepared for storage without the use of tools, as is standard for other ball racks currently available.

The ball rack includes a variety of accessories to alleviate storage and portability. These accessories include, but are not limited to, a cushioned carrying and storage case, a miniature bag to carry the rack beams, and a dual ball bag/rack cover designed to hold up to 15 balls and store the ball rack in its erected, fully expanded mode.

There has thus been outlined, rather broadly, the more important features of a ball rack and training apparatus and thus, the description thereof that follows may be better understood, and in order that the present contribution to the art may be better appreciated. There are additional features of the system that will be described hereinafter and which will form the subject matter of the claims appended hereto.

In this respect, before explaining at least one embodiment of the system in detail, it is to be understood that the system is not limited in its application to the details of construction, assembly and arrangements of the components set forth in the following description or illustrated in the drawings. The system is capable of other embodiments and of being practiced and carried out in various ways. Also, it is to be understood that the phraseology and terminology employed herein are for the purpose of description and should not be regarded as limiting.

These together with other objects of the system, along with the various features of novelty, which characterize the system, are pointed out with particularity in the claims annexed to and forming a part of this disclosure. For a better understanding of the system, its operating advantages, and the specific objects attained by its uses, reference should be made to the accompanying drawings and descriptive matter in which there are illustrated preferred embodiments of the system.

BRIEF DESCRIPTION OF THE DRAWINGS

The system may be more completely understood in consideration of the following detailed description of various embodiments of the system in connection with the accompanying drawings, in which.

Figure 1:
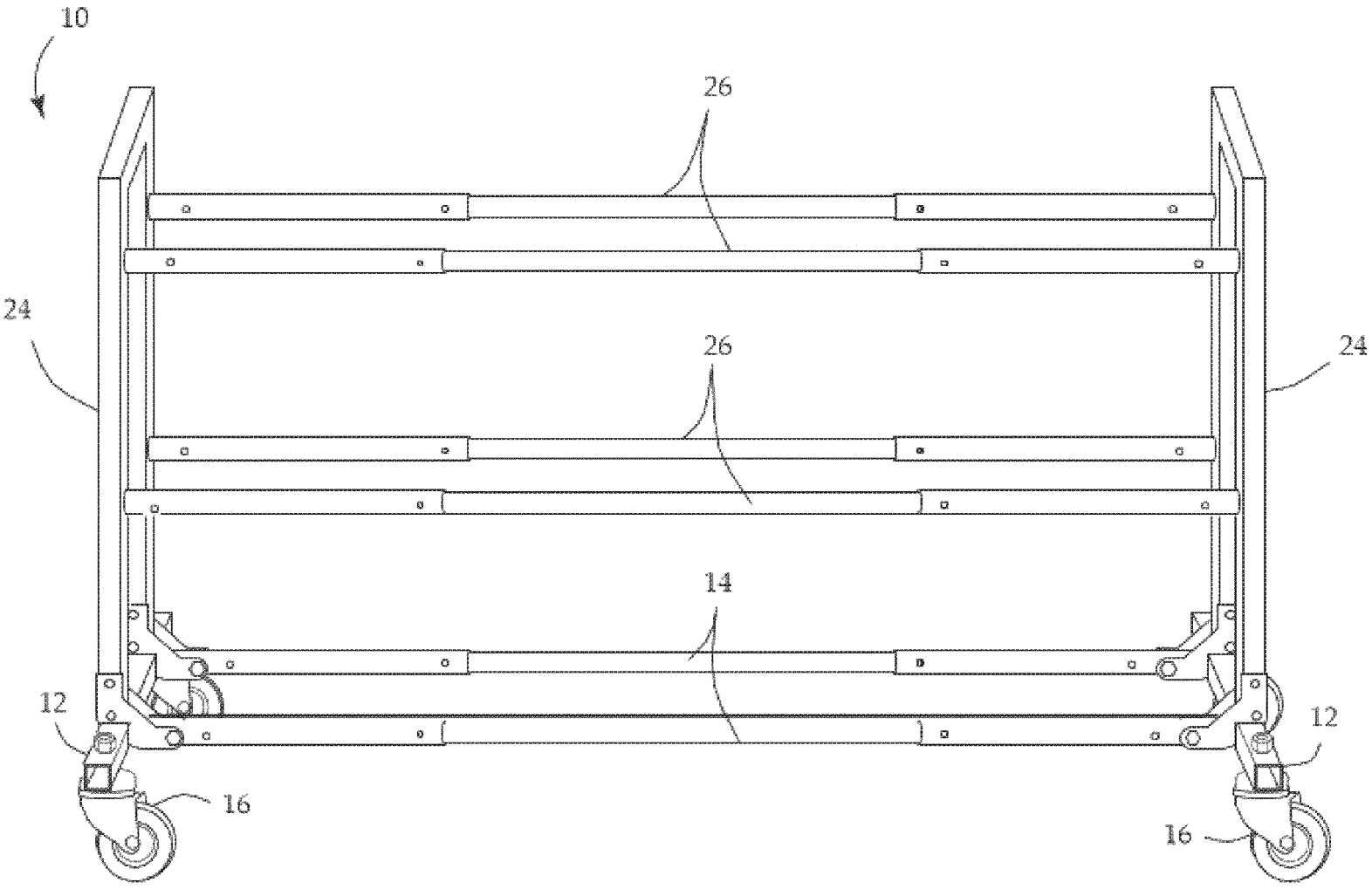
FIG. 1 is a perspective view of a ball rack according to the present disclosure of the ball rack being assembled in one configuration.

While the system is amenable to various modifications and alternative forms, specifics thereof have been shown by way of example in the drawings and will be described in detail. It should be understood, however, that the intention is not to limit the system to the particular embodiments described. On the contrary, the intention is to cover all modifications, equivalents, and alternatives falling within the spirit and scope of the system.

DETAILED DESCRIPTION OF THE PREFERRED EMBODIMENTS

The ball rack 100 provides various independent and interchangeable components that can be assembled by the user into a variety of desired configurations for training and coaching at least one sports skill. As best seen in FIG. 1, the ball rack 10 includes a main base frame, made up of at least two short members 12, at least two long members 14, and at least four wheeled accessories 16. These components are also referred to as the base components.

The main base frame is preferably configured as a ball rack having a substantially rectangular frame. These base components 12, 14, 16 provide rigidity and stability for the overall shape of the ball rack 10 in order to maintain the overall substantially rectangular frame.

Figure 2:
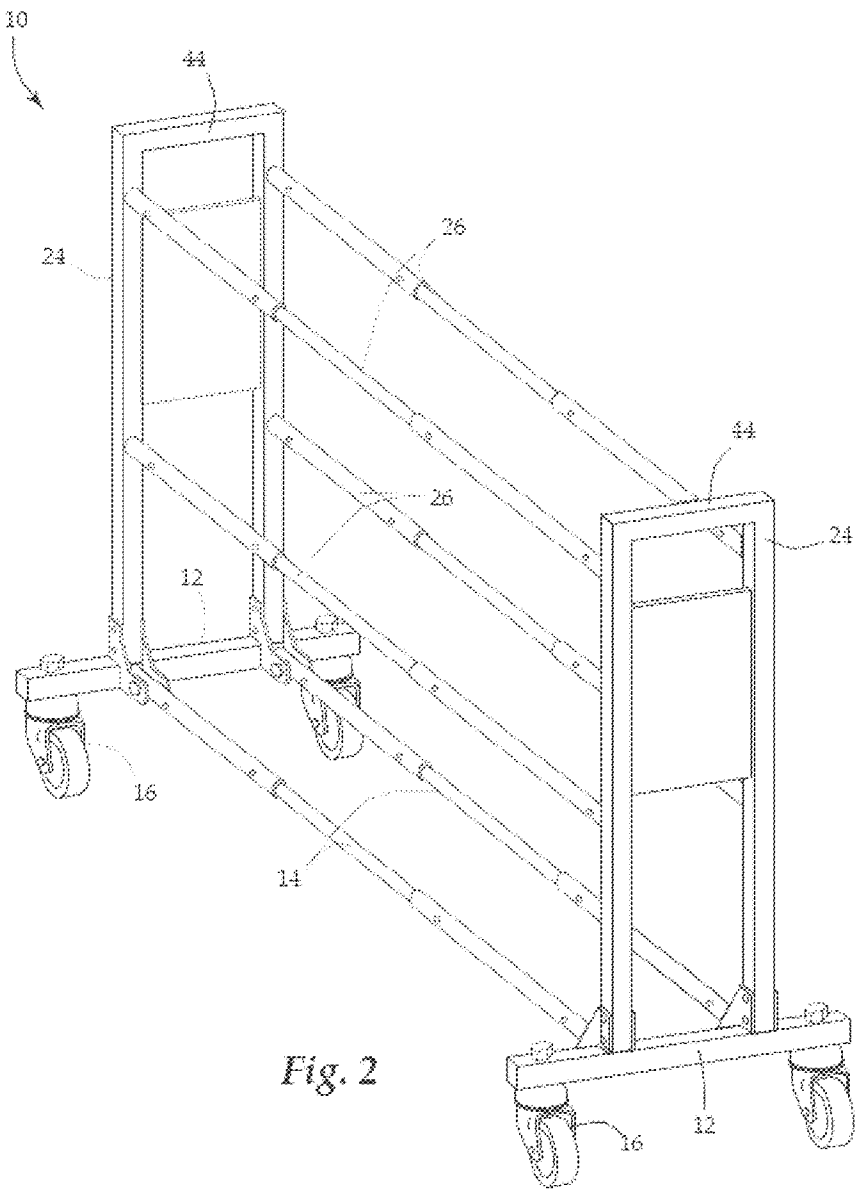
FIG. 2 is a left side perspective view thereof.

As shown in a preferred embodiment in FIG. 2, the at least two short members 12 are attached to at least one set of upright vertical frame bars 24. The at least one set of vertical frame bars 24 are further connected with a top horizontal piece 44, serving as a handle.

In this embodiment, the at least two long members 14 run parallel to at least one set of detachable horizontal rack beams 26 that connect to the at least one set of upright vertical frame bars 24 via a hook and lock mechanism.

Figure 3:
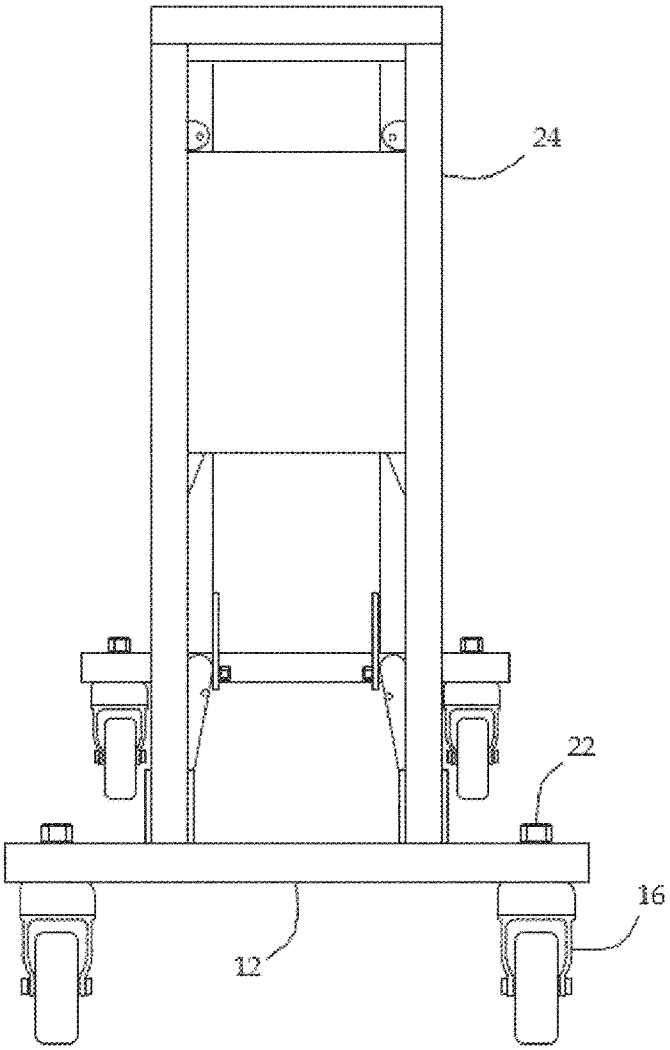
FIG. 3 is a left side view thereof.

As shown in a preferred embodiment in FIG. 3, the at least two short members 12 are also attached to at least one wheeled accessory 16 via a screw 18 and wingnut 22. Other embodiments may use different methods of connection.

Figure 4:
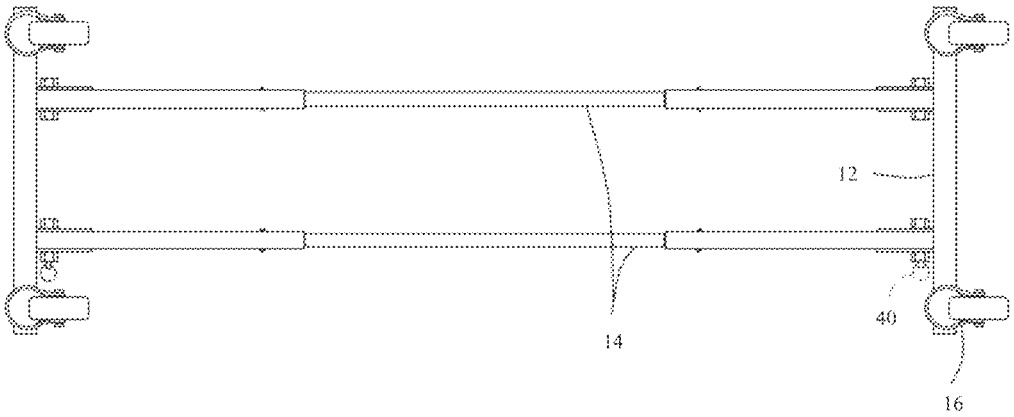
FIG. 4 is a bottom view thereof.
Figure 5:
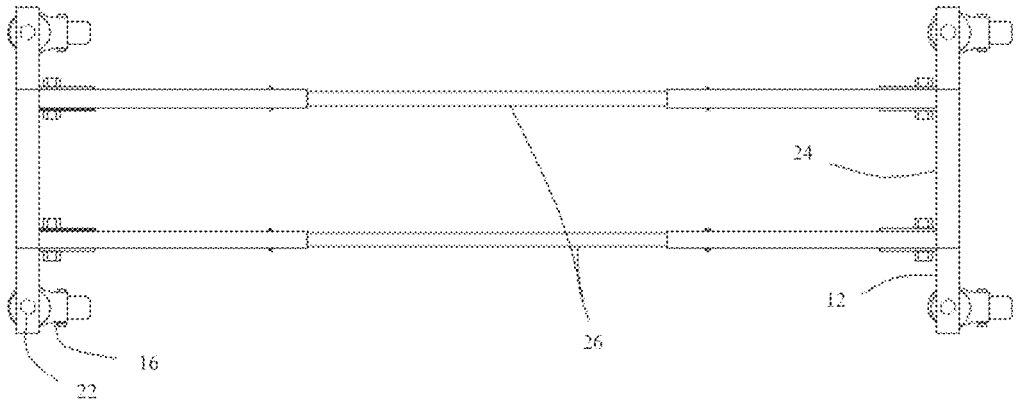
FIG. 5 is a top view thereof.

As shown in a preferred embodiment in FIG. 4 and FIG. 5, the base components 12, 14, 16 form a substantially rectangular frame. The substantially rectangular shape is maintained through the alignment of the detachable horizontal rack beams 26 with the at least two long members 14 and the top horizontal piece 44 with the at least two short members 12.

Figure 6:
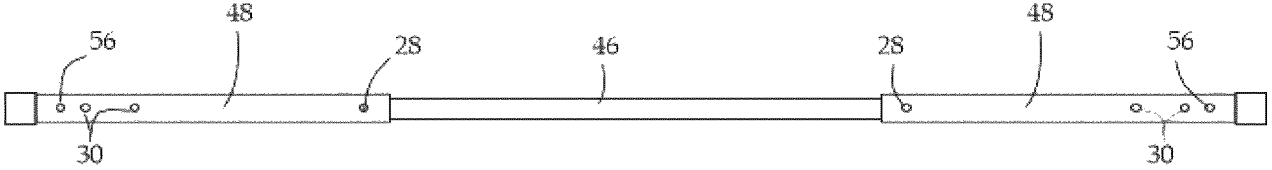
FIG. 6 is a side view of a long member for a ball rack according to the present disclosure.

As best seen in FIG. 6, the long members 14 utilize a telescoping mechanism which allows the long members 14 to extend or withdraw via a pin and hole mechanism. The hole 30 is filled by the pin 28 at the desired width, and the extending members 46 withdraws or extends from the base members 48. The pins 28 and holes 30 are preferably located on the side of the long members 14 so as to allow athletic balls and other sports equipment to sit flush on the top side of the long members 14.

Figure 7A:
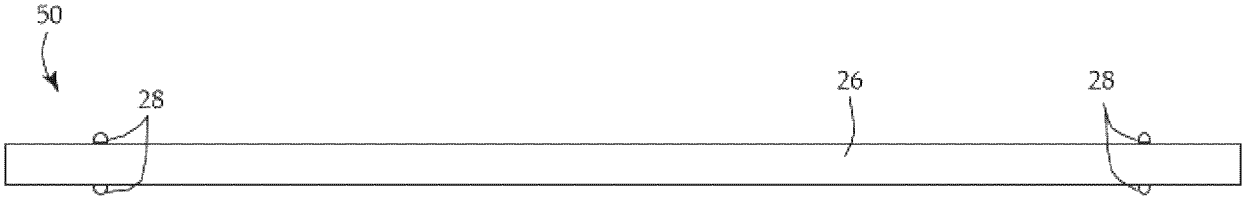
FIG. 7A is a front view of an extending member of a detachable horizontal rack beam thereof.
Figure 7B:
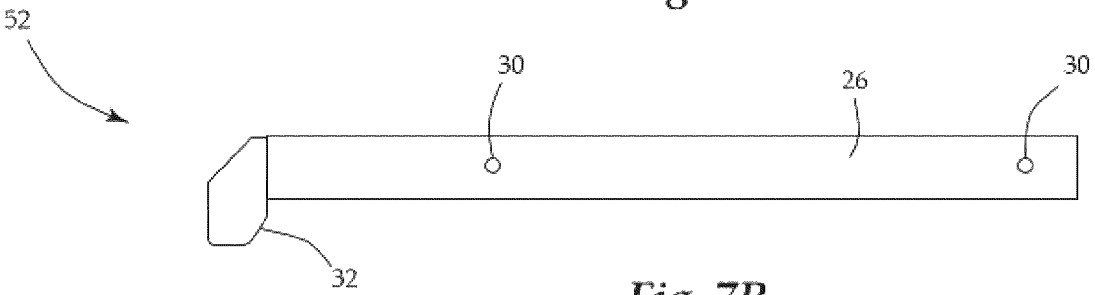
FIG. 7B is a front view of a base member of a detachable horizontal rack beam thereof.

Additionally, as best seen in FIGS. 7A and 7B, each detachable horizontal rack beam 26 is preferably configured with telescoping arms locked into the desired width with a pin and hole mechanism. The hole 30 is filled by the pin 28 at the desired width, and the extending members 50 withdraws or extends from the base members 52. The pin and hole mechanism is preferably located on the side of each detachable horizontal rack beam 26 so as to allow athletic balls and other sports equipment to sit flush on the top side of each detachable horizontal rack beam 5.

In this embodiment, the holes 30 in the base member 48 of the long members 14 are spaced at the same distance as the holes 30 in the base member 52 of the detachable horizontal rack beams 26.

Figure 8:
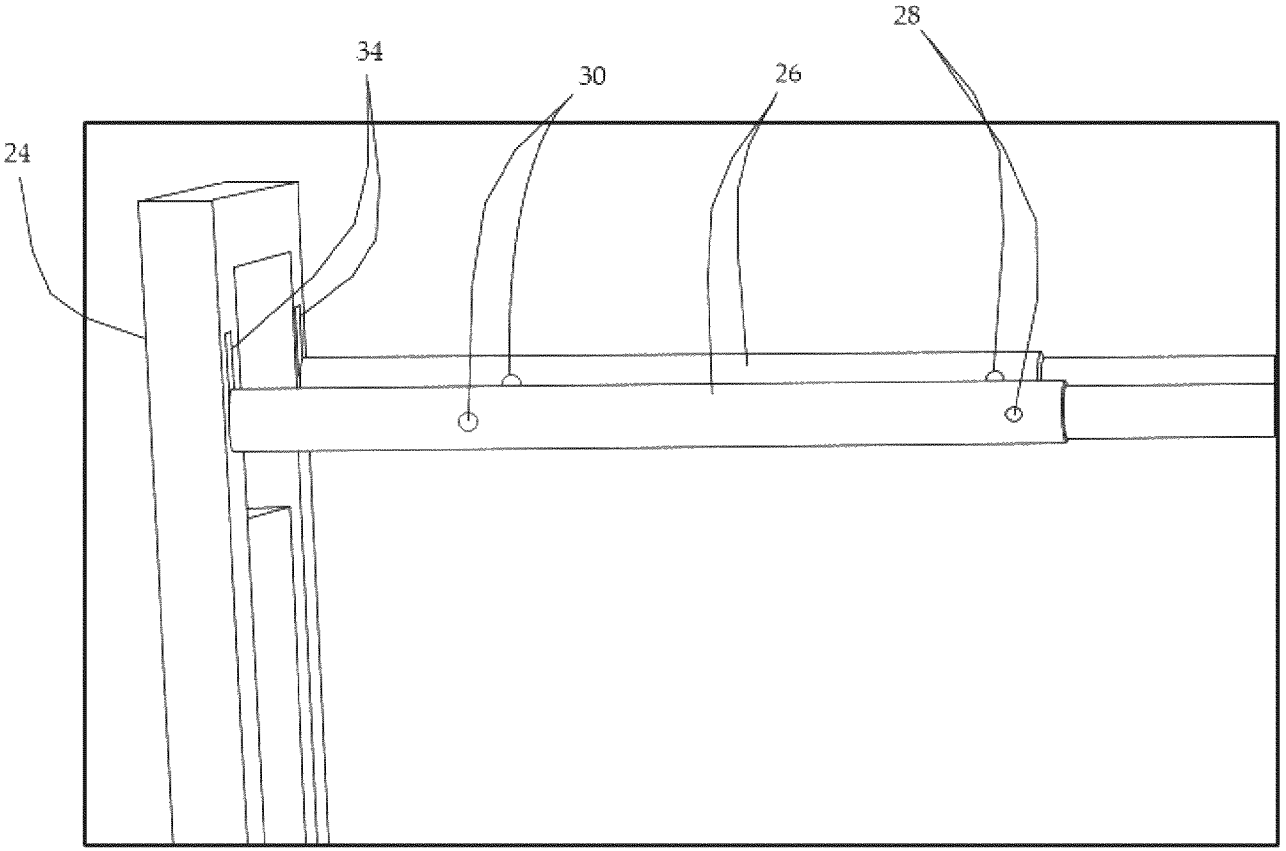
FIG. 8 is a perspective view of a pin and hole locking mechanism thereof.
Figure 9:
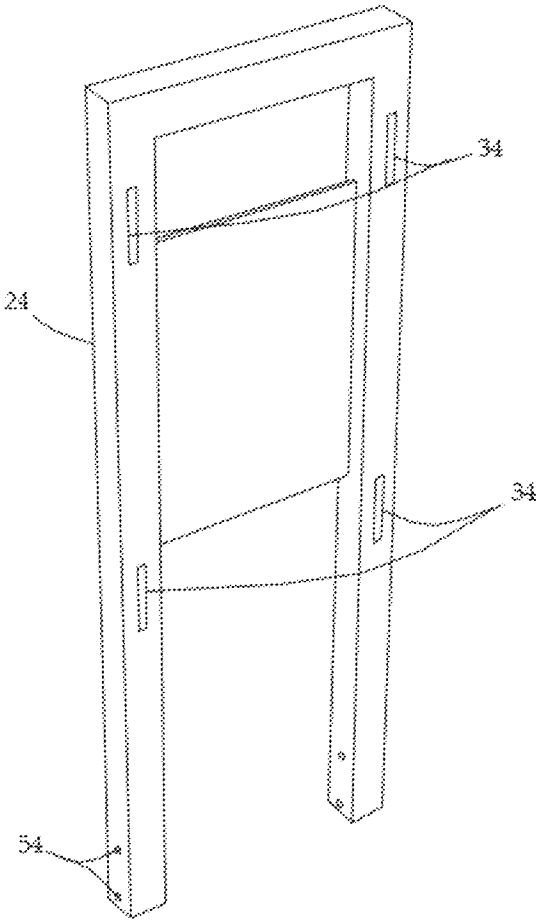
FIG. 9 is a perspective view of a set of upright vertical frame bars thereof.
Figure 10:
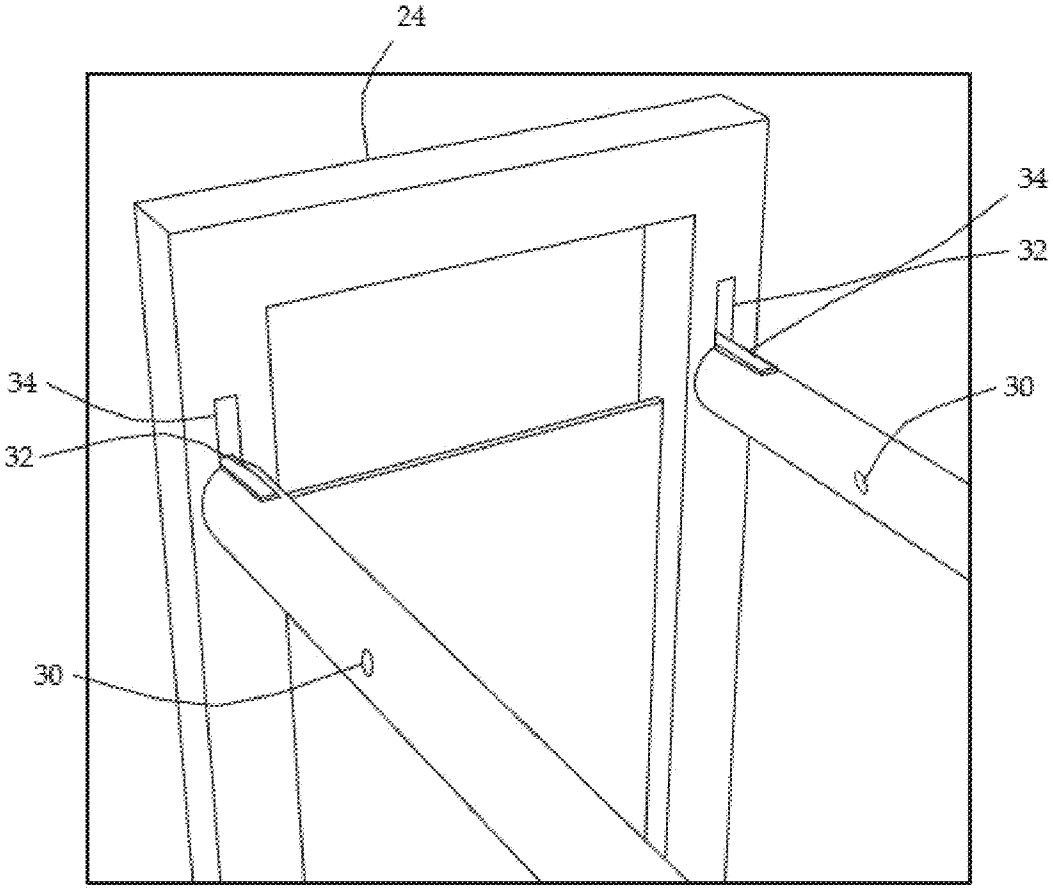
FIG. 10 is a perspective view of a first hook and lock mechanism thereof.

As shown in a preferred embodiment in FIG. 8-10, the detachable horizontal rack beams 26 are attached to the upright vertical frame bars 24 via a hole and hook mechanism. The detachable horizontal rack beams 26 have a hook 32 on each end, configured to hole into a vertical slot 34 which may be located at different heights and situated on the inner side of the upright vertical frame bars 24. The vertical slots 34 are spaced equidistant on the upright vertical frame bars 24 to accommodate and mount sports equipment, as shown in FIG. 9.

Figure 11:
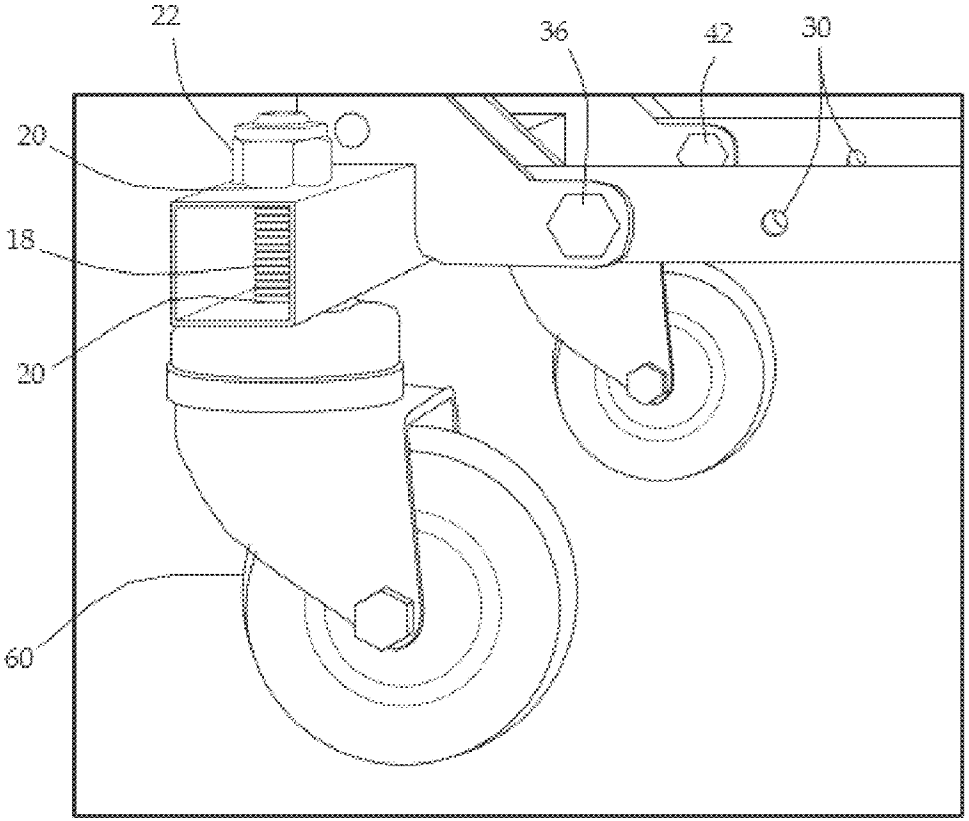
FIG. 11 is a side view of a wheeled accessory thereof.
Figure 12:
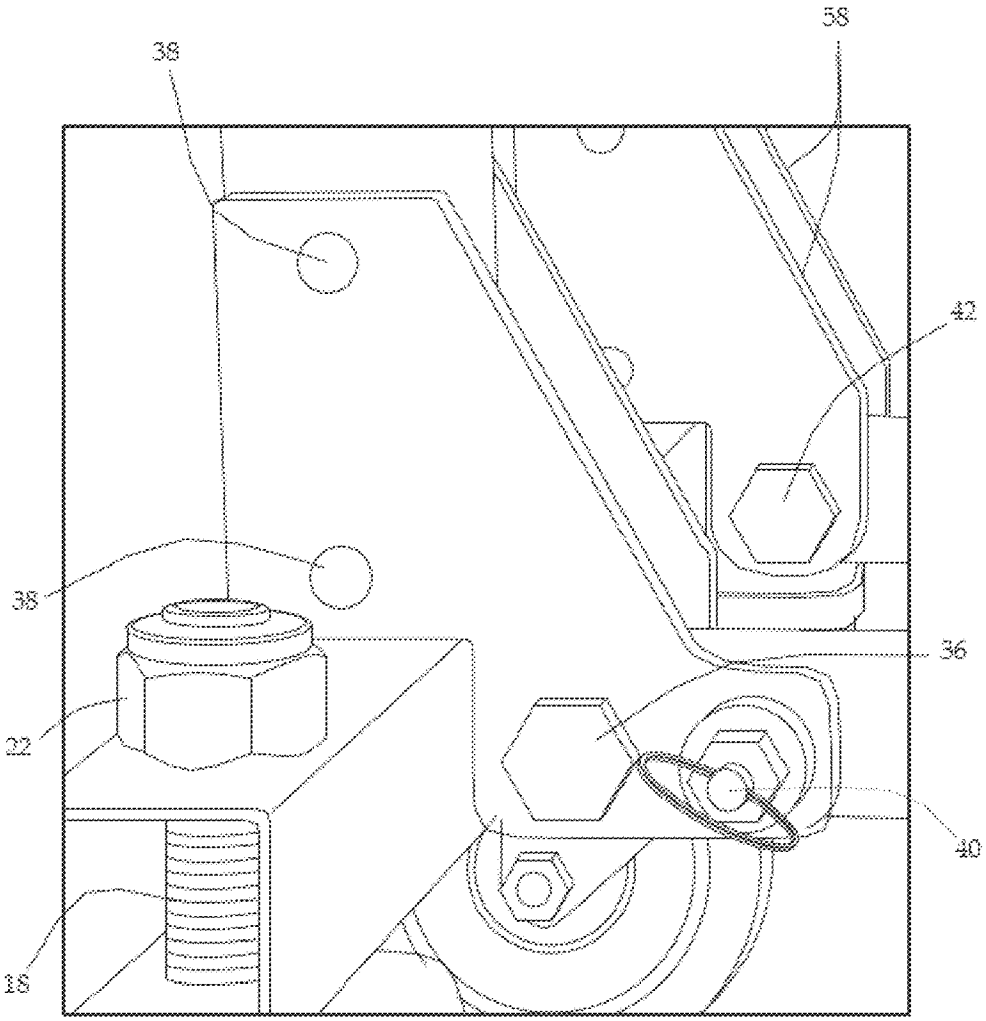
FIG. 12 is a right side view of a first hinge mechanism thereof.
Figure 13:
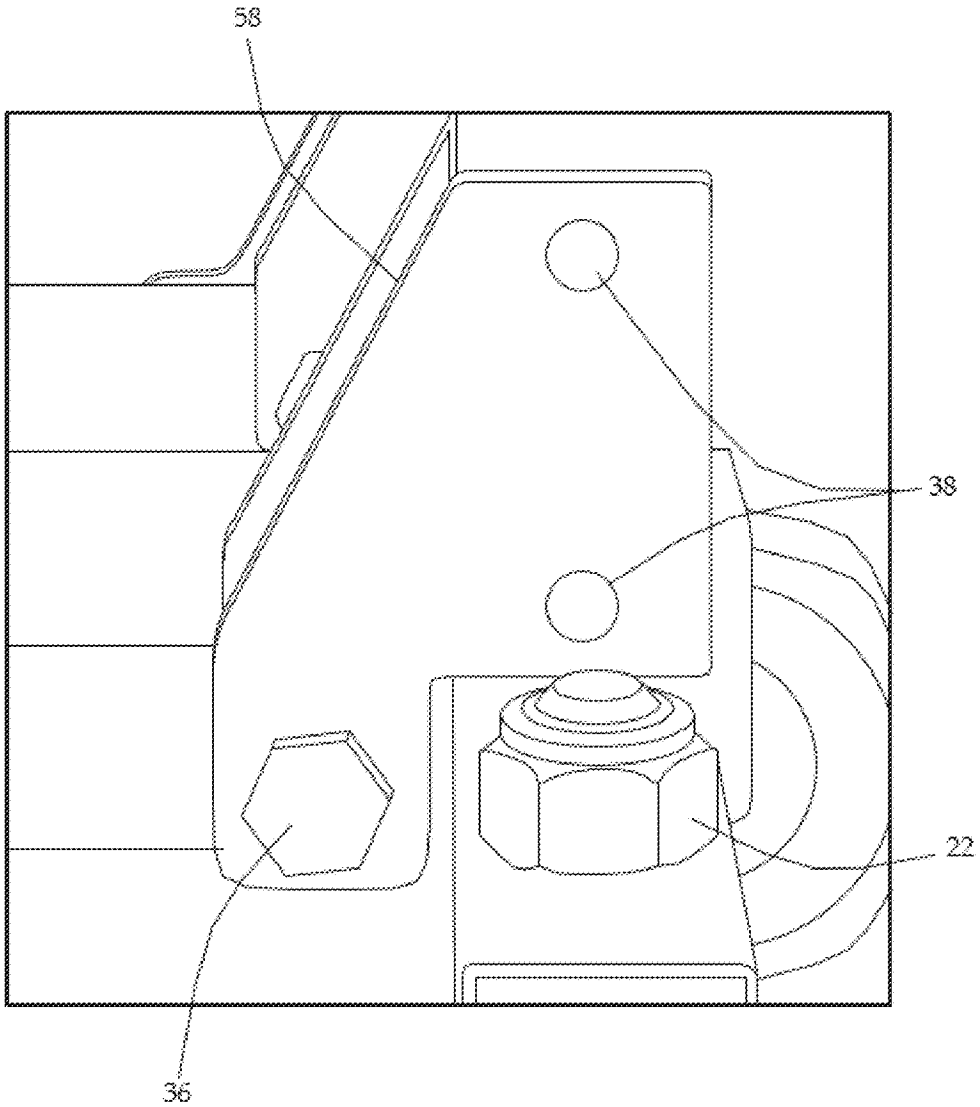
FIG. 13 is a left side view of a first hinge mechanism thereof.
Figure 14:
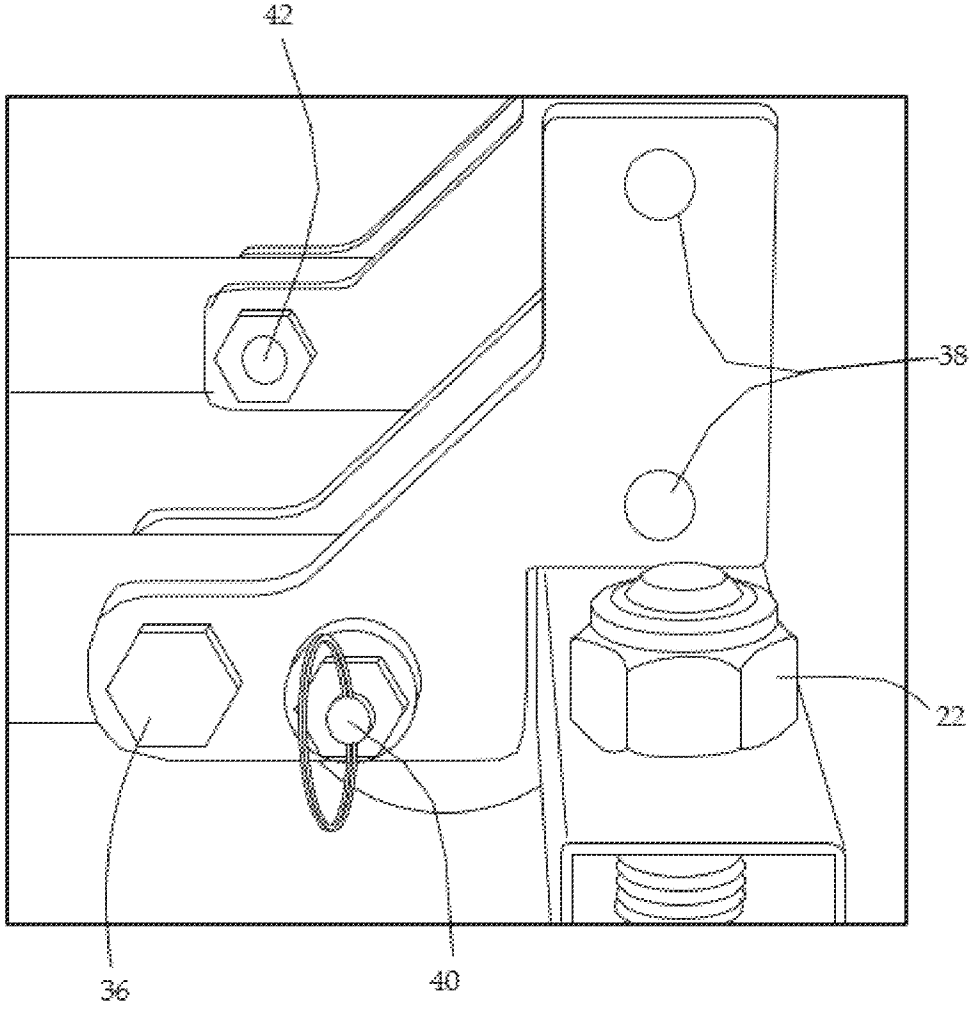
FIG. 14 is a left side view of a second hinge mechanism thereof.
Figure 15:
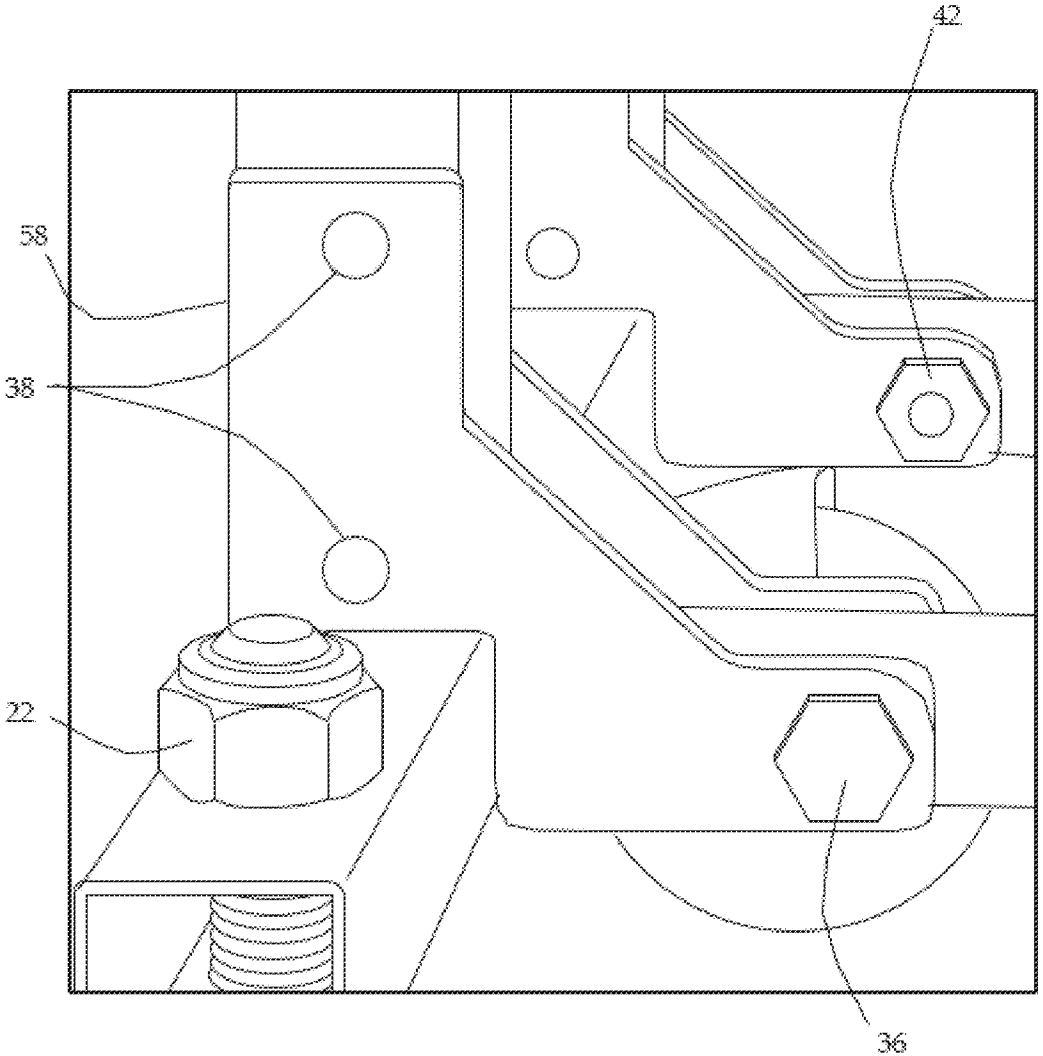
FIG. 15 is a right side view of a second hinge mechanism thereof.

As shown in a preferred embodiment in FIG. 11, the main base frame is provided with at least two short members 12 with a set of wheel accessories 16 preferably secured into place by a screw 18 at each end of the short members 12. In this embodiment, the wheel accessories 16 have a wheel part 60 which extends upward so that the set of wheel accessories 60 are perpendicular to the short members 12, and the wheel part 60 has a screw hole 20 which allows a screw 18 and wingnut 22 to secure the wheel accessories 16 in place. In another embodiment, a wheel part 60 extends upward so that the wheel accessories 16 are perpendicular to the short members 12, and the wheel part 60 has a bolt hole which allows a bolt on the end of the short member 12 to secure the wheel accessories 16 in place.

The ball rack 10 includes at least four upright vertical frame bars 24 which are attached to the main base frame via a hinge mechanism.

As best seen in FIG. 12-15, the preferred embodiment uses two variations of a hinge mechanism. As shown, the hinge mechanism of FIG. 12-13 differs only in the shape of a hinge plate 58 from that of FIG. 14-15. The hinge mechanisms preferably include female hollow sections 54 on the upright vertical frame bar 24 and blind rivets 38 that fit into these female hollow sections to hold the hinge plate 58 in place. Similarly, the long members 14 contain female hollow sections 56 in which hex head screws 36 and retractable spring plungers 40 of the hinge mechanisms are secured. The retractable spring plungers 40 locks the vertical frame bars 24 in place, providing stability to the ball rack 10.

Figure 16A:
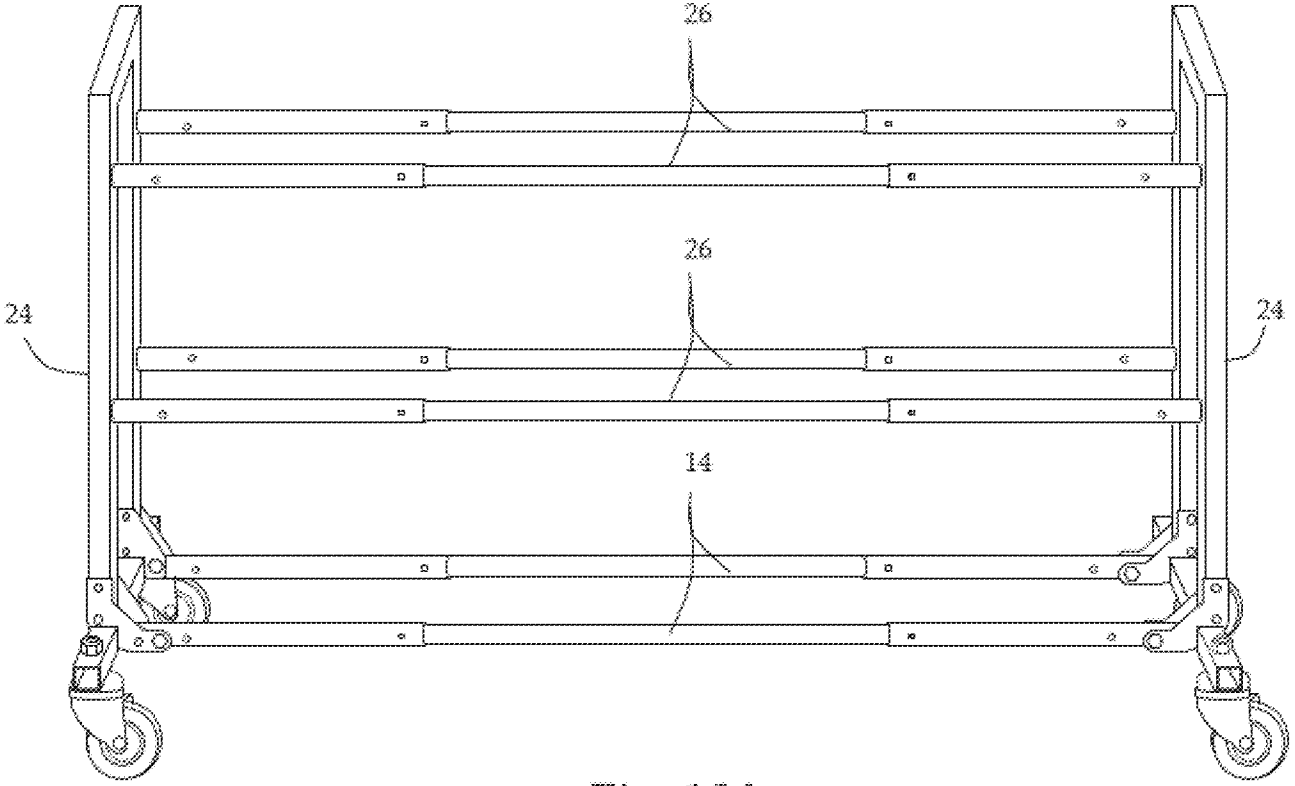
FIG. 16A-16F are perspective views of a method of folding a ball rack according to the present disclosure.
Figure 16B:
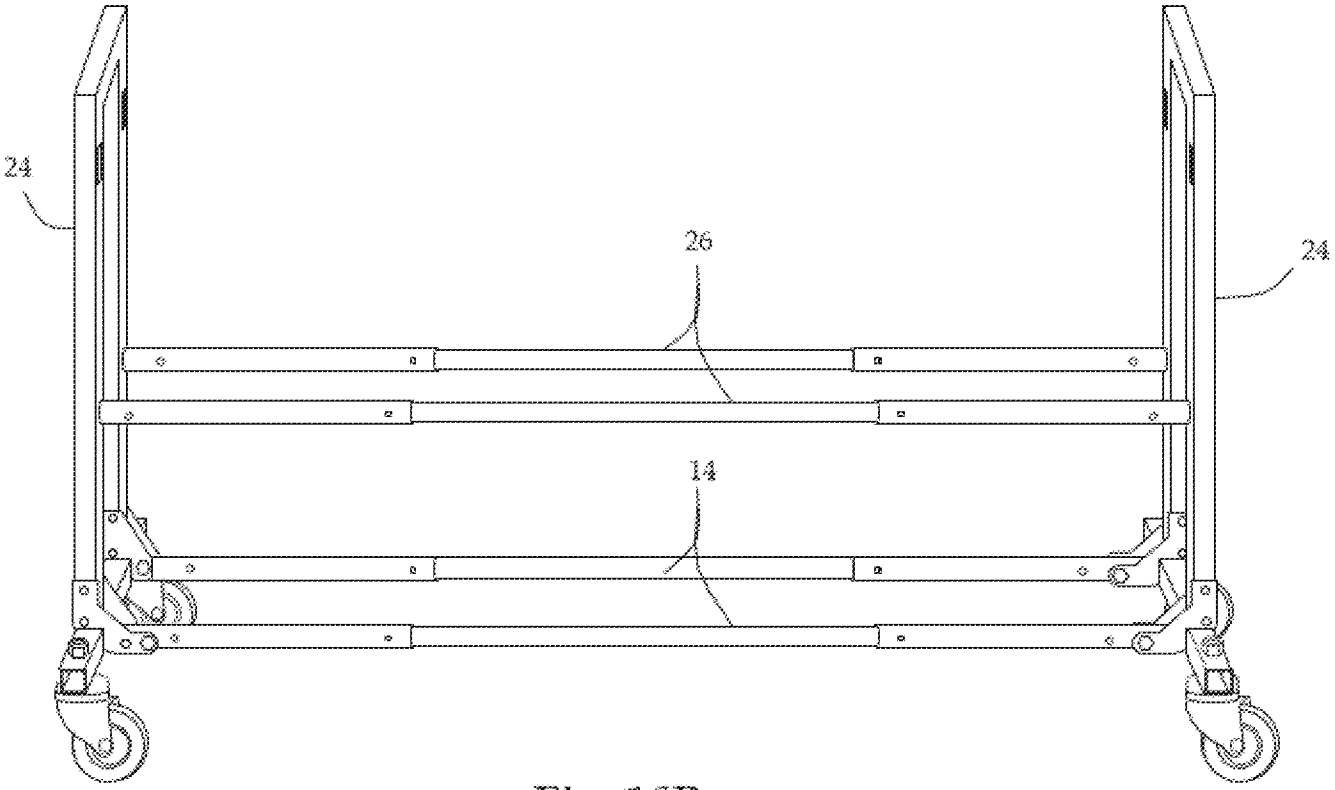
Figure 16C:
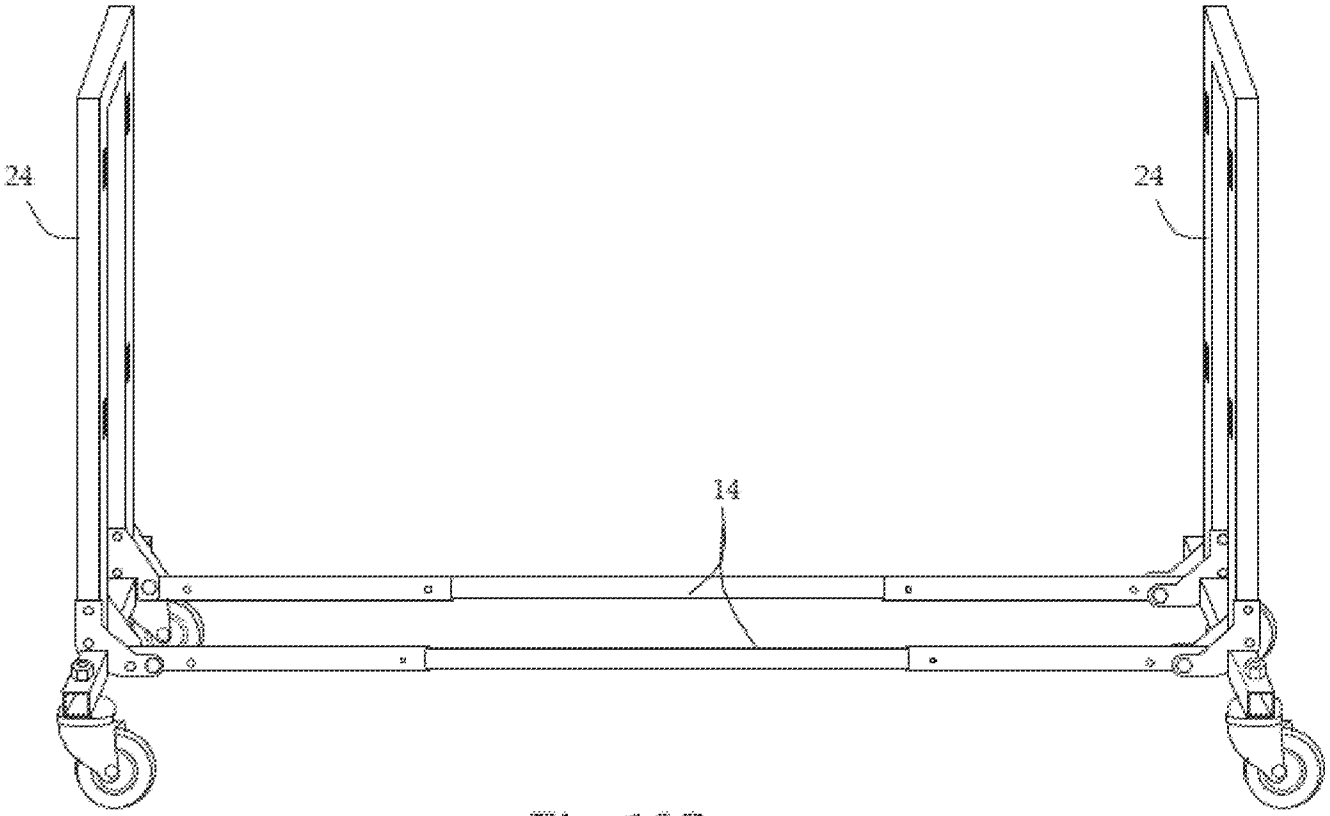
Figure 16D:
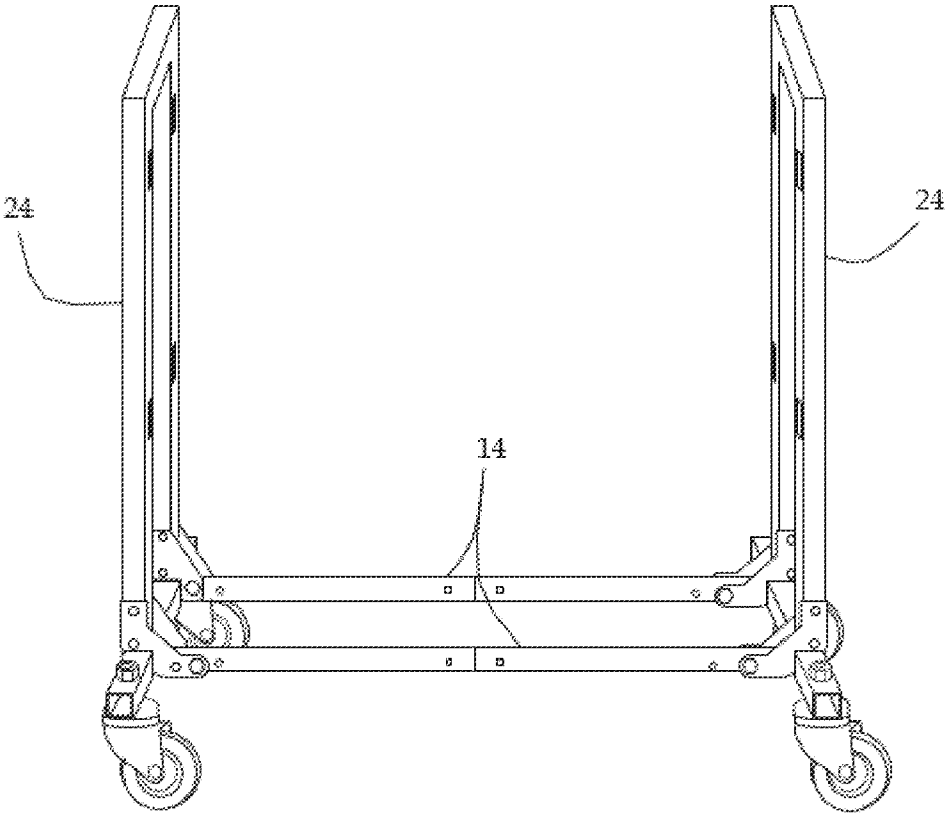
Figure 16E:
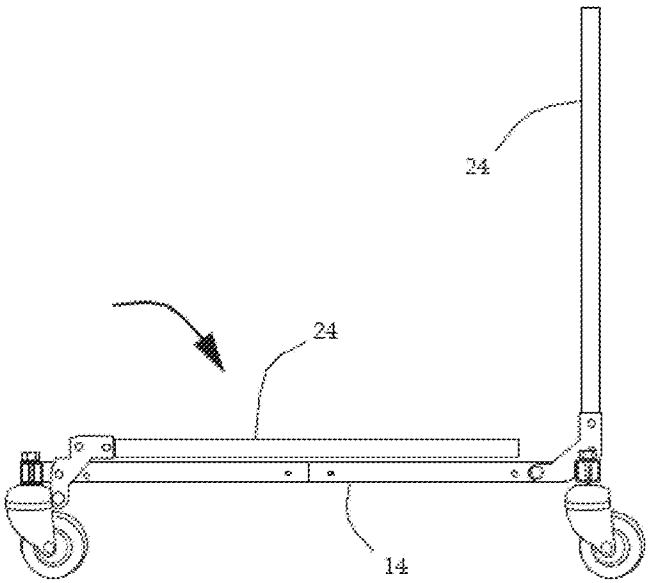
Figure 16F:
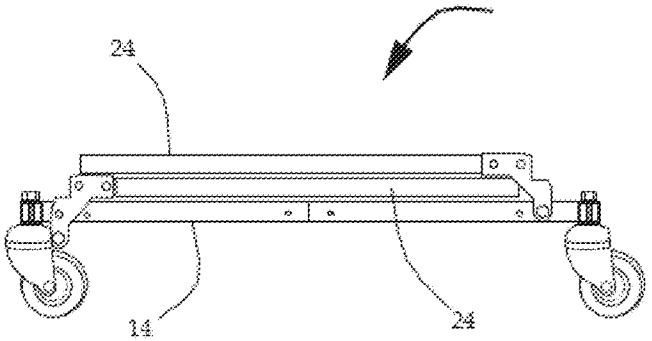
Figure 17:
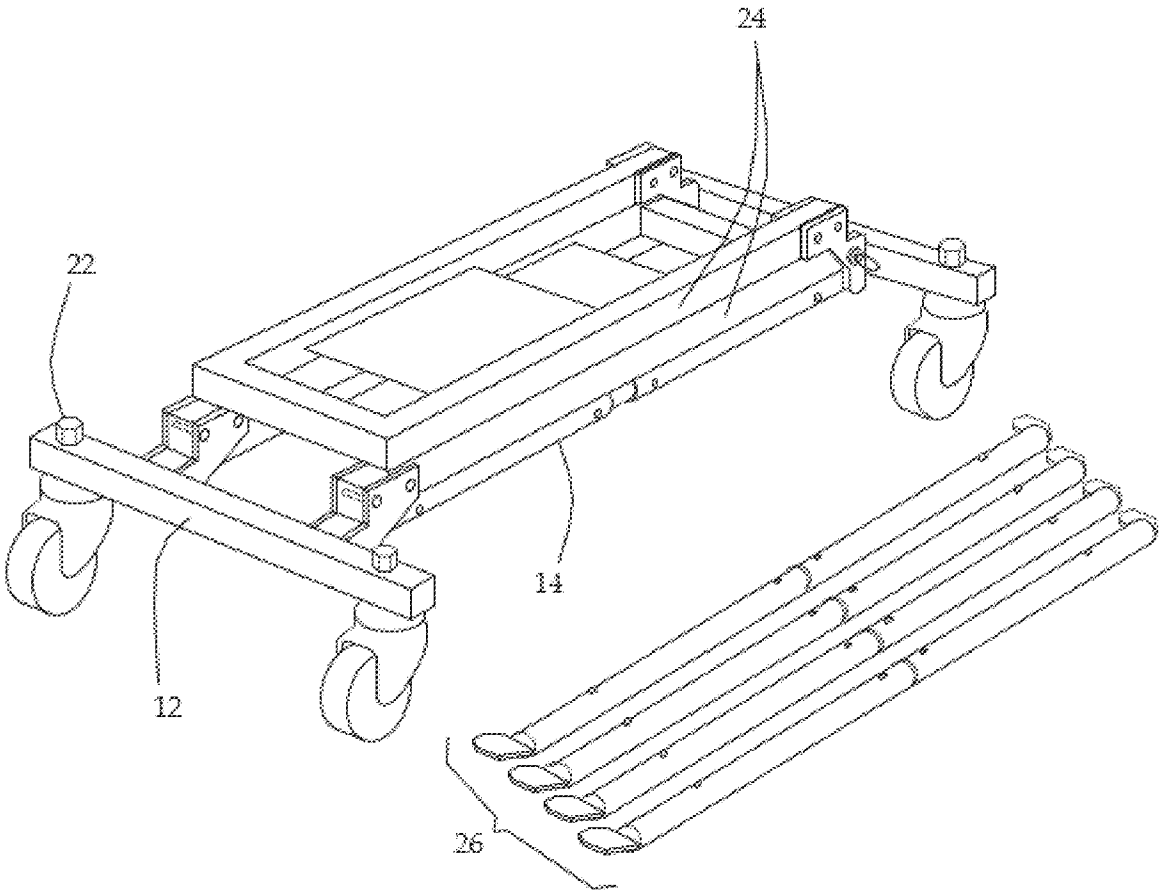
FIG. 17 is a perspective view of a ball rack in dolly/storage mode with detached detachable horizontal rack beams according to the present disclosure.
Figure 18:
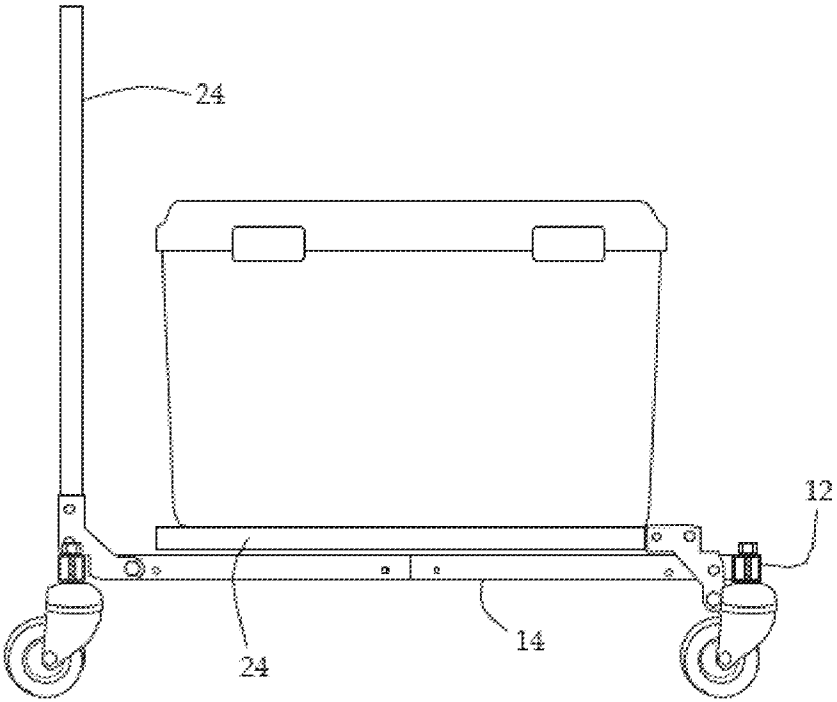
FIG. 18 is a perspective view of a ball rack in cart mode according to the present disclosure.

Further, the hinge mechanism facilitates the transformation of the ball rack 10 into other configurations. FIG. 16A-16F show how the ball rack 10 is preferably transformed into its storable configuration, or dolly/storage mode, as shown in FIG. 17. The dolly/storage mode is accomplished when the detachable horizontal rack beams 26 are removed by taking the hook 32 out of the aperture 34 in the vertical frame bar 24, as shown in FIG. 16B-16C, the pin and hole mechanism on the long members 14 is used to make the long members 14 as short as possible, as shown in FIG. 16D, and the hinge mechanism located on the outward portion the vertical frame bars 24 is unlocked and the upright vertical frame bars 24 are made parallel to the long members 14, as shown in FIG. 16E.

The portable mode, or cart mode is achieved through the same process, except only one set of vertical frame bars 24 are made parallel to the long members 14 via the unlocking of the associated hinge mechanisms.

In order to properly assemble the ball rack 10 from a folded configuration into its erected and expanded configuration, the detachable horizontal rack beams 26 must be locked into place perpendicular from the upright vertical frame bars 24 via a hook and lock mechanism. Each detachable horizontal rack beam 26 preferably has a hook 32 on each end of the detachable horizontal rack beam 26, configured to hole into the aperture 34 situated on the inner side of the upright vertical frame bars 24, spaced equidistant on the upright vertical frame bars 24 to accommodate and mount sports equipment.

Figure 19:
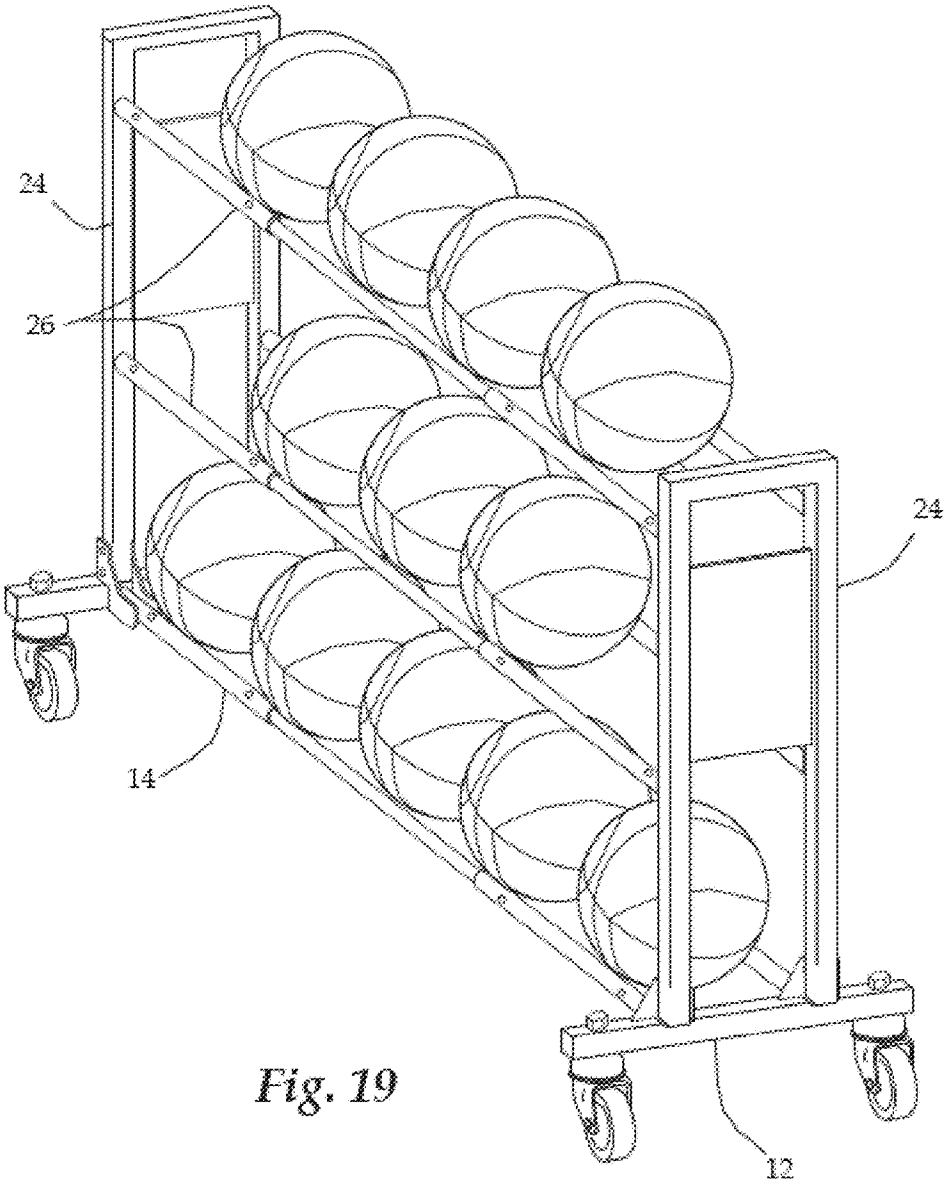
FIG. 19 is a perspective view of a ball rack in 5-ball mode according to the present disclosure.
Figure 20:
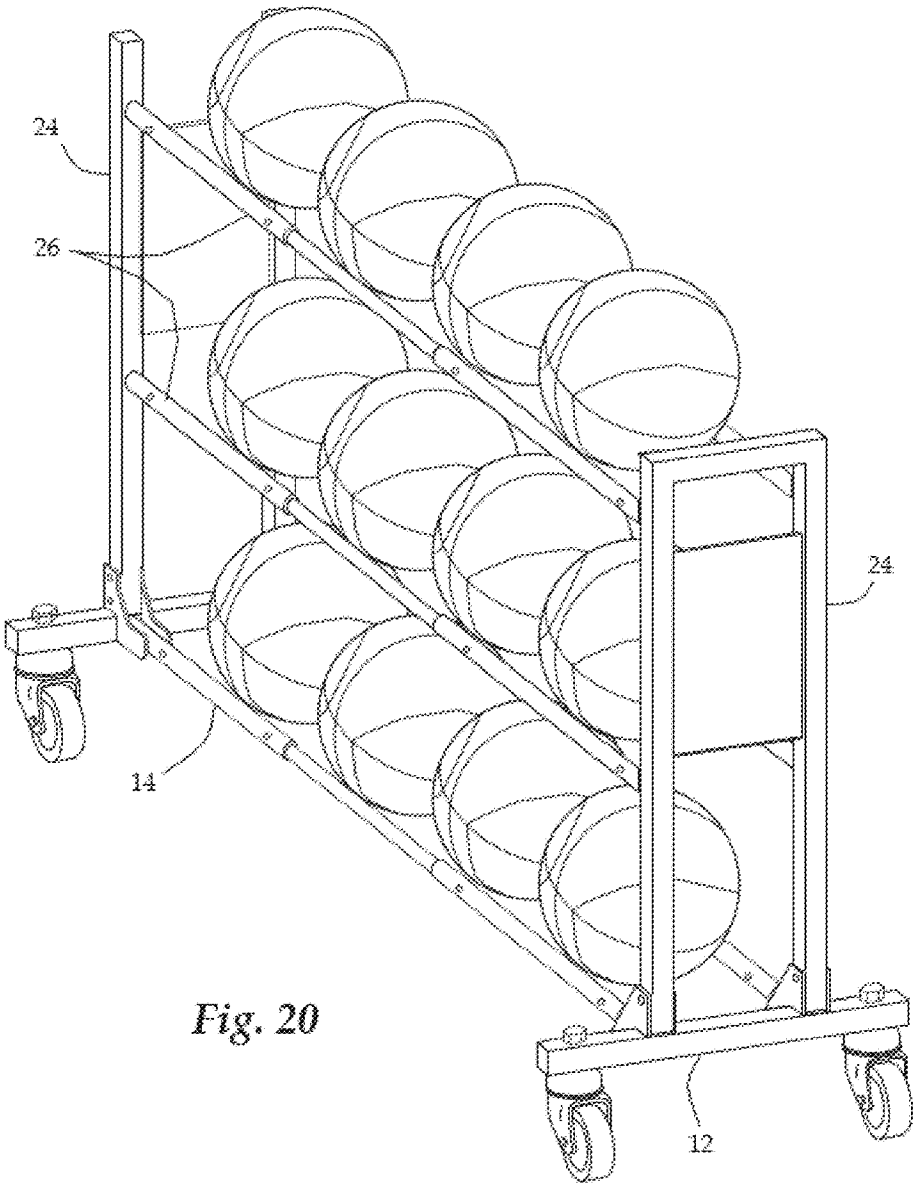
FIG. 20 is a perspective view of a ball rack in 4-ball mode according to the present disclosure.
Figure 21A:
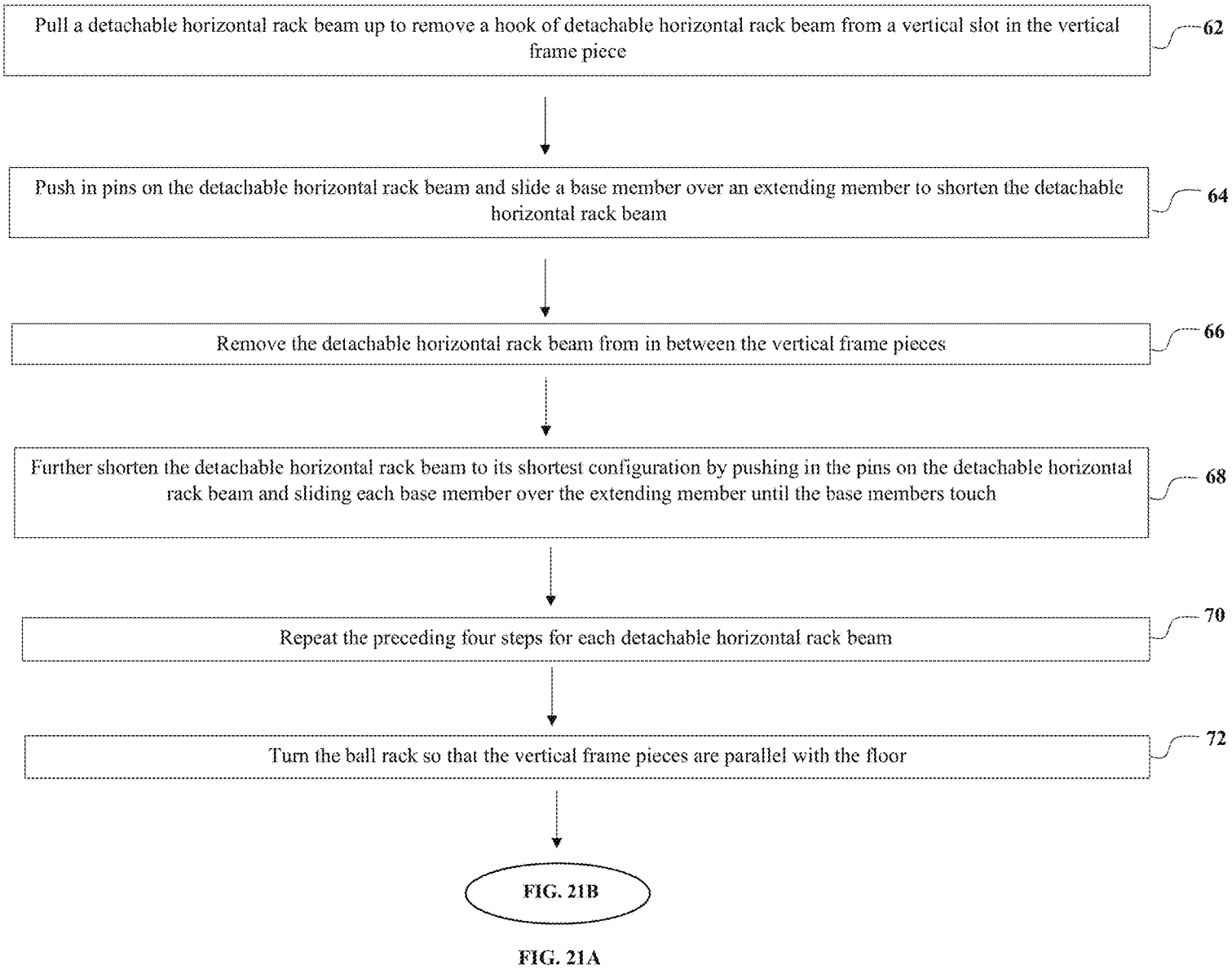
FIG. 21A-C is a flow chart displaying a method for folding the ball rack of into a storable configuration.
Figure 21B:
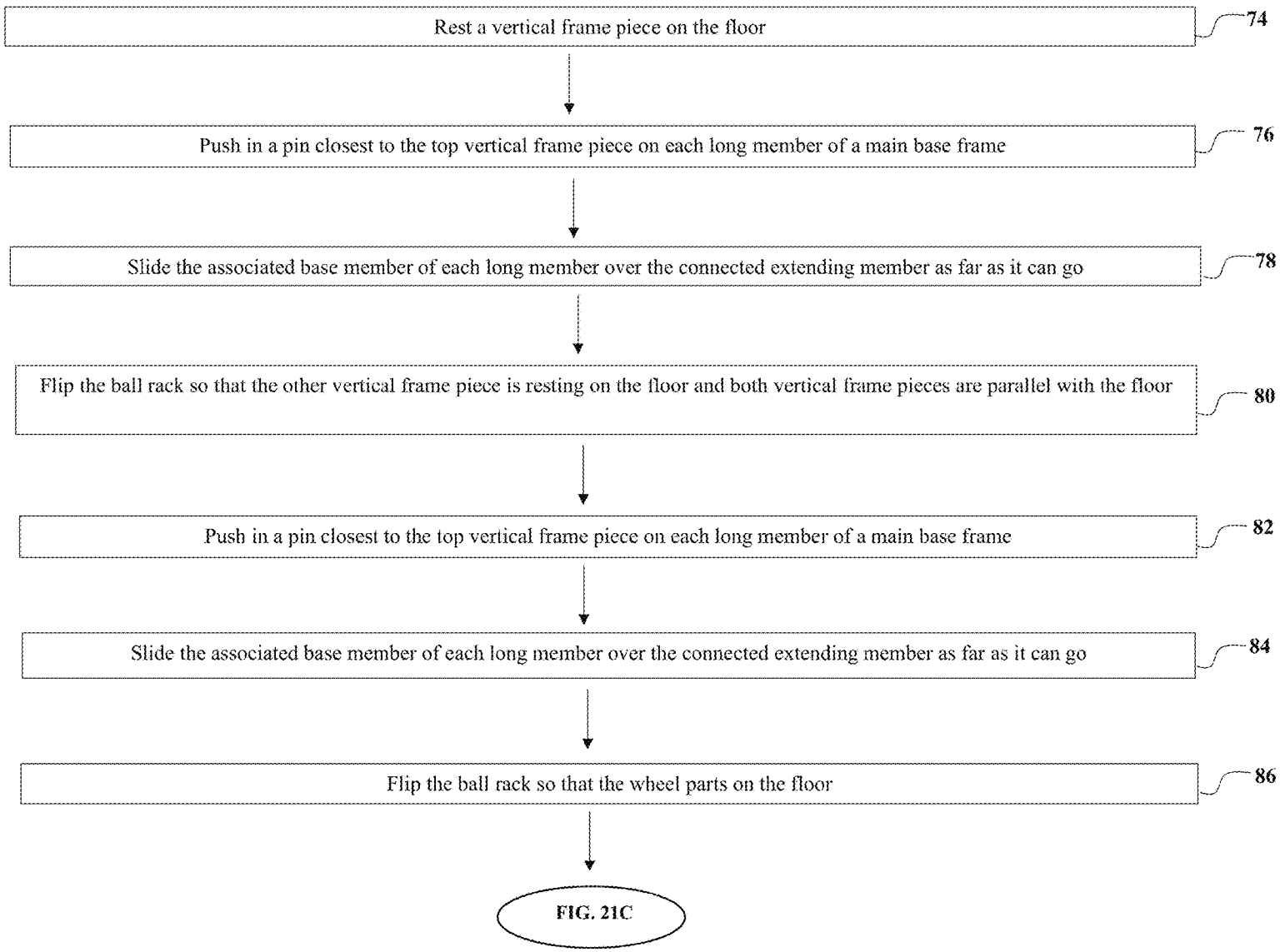
Figure 21C:
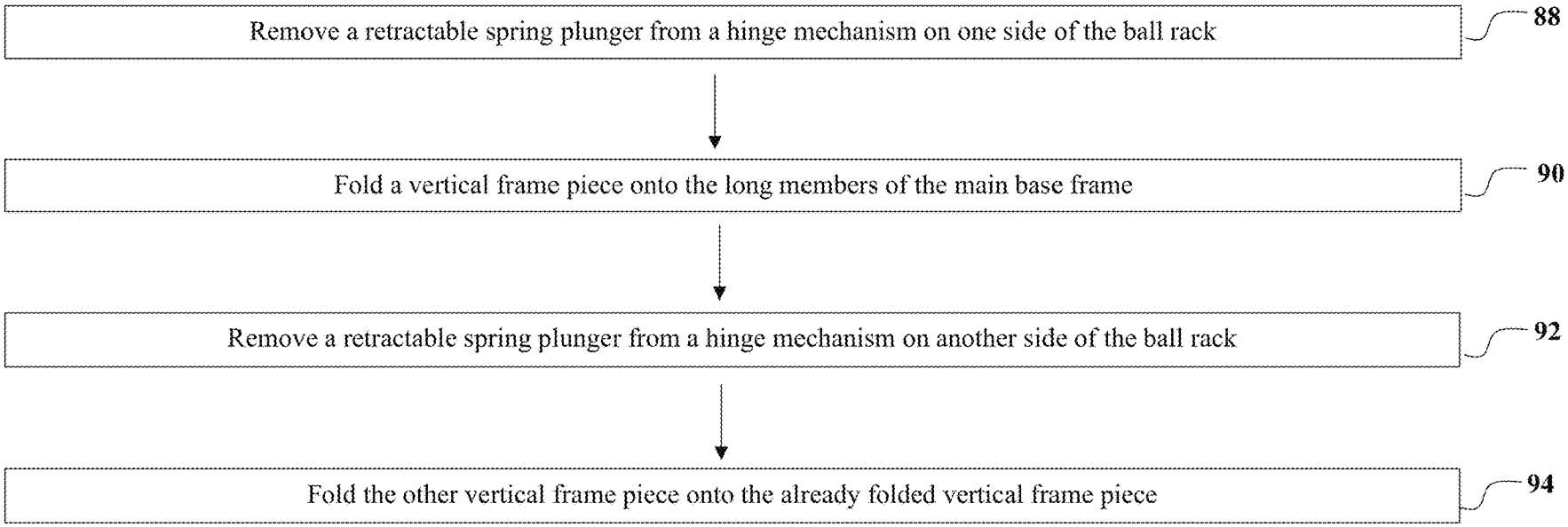
Figure 22A:
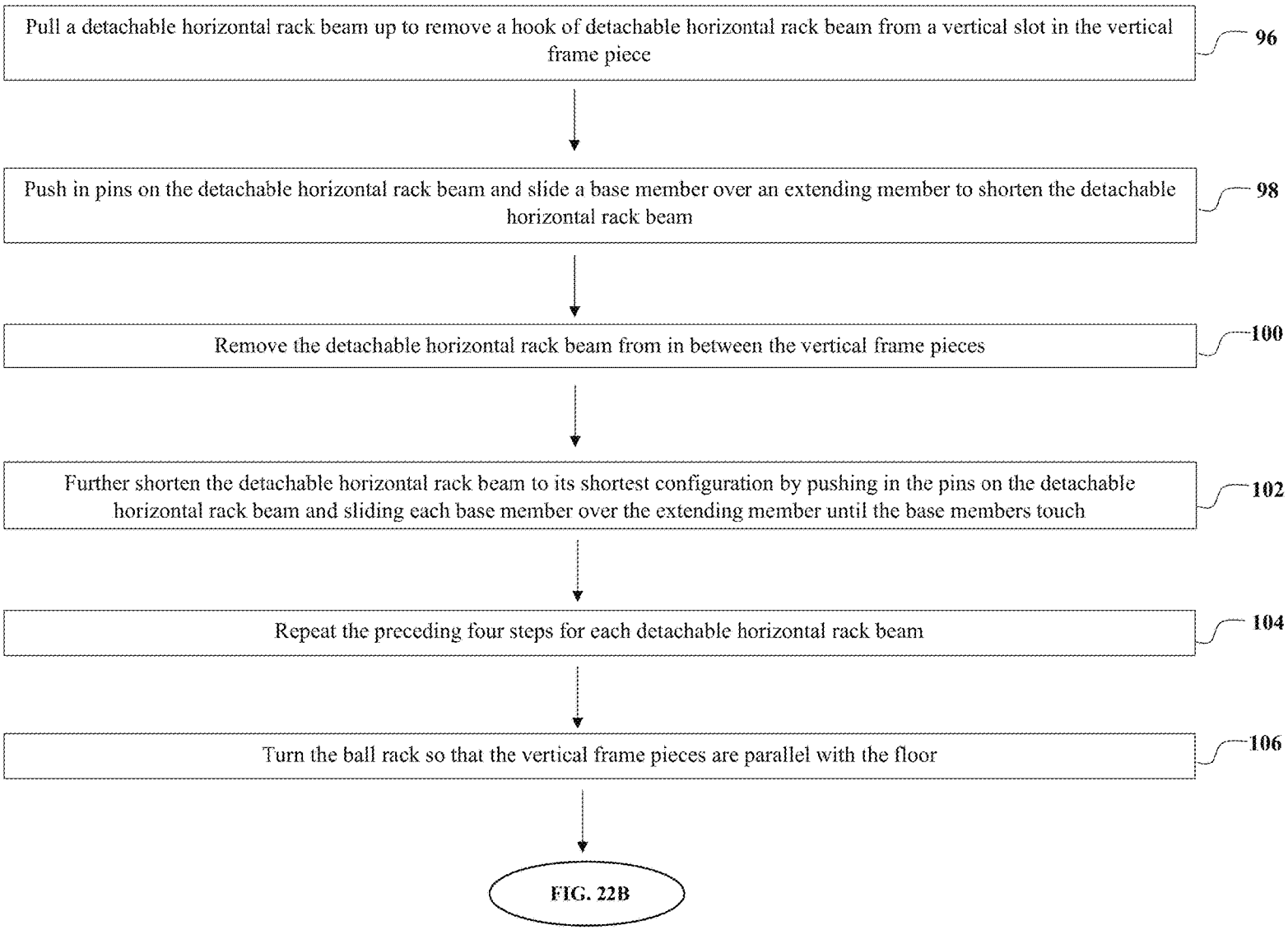
FIG. 22A-C is a flow chart displaying a method for folding the ball rack into a portable configuration.
Figure 22B:
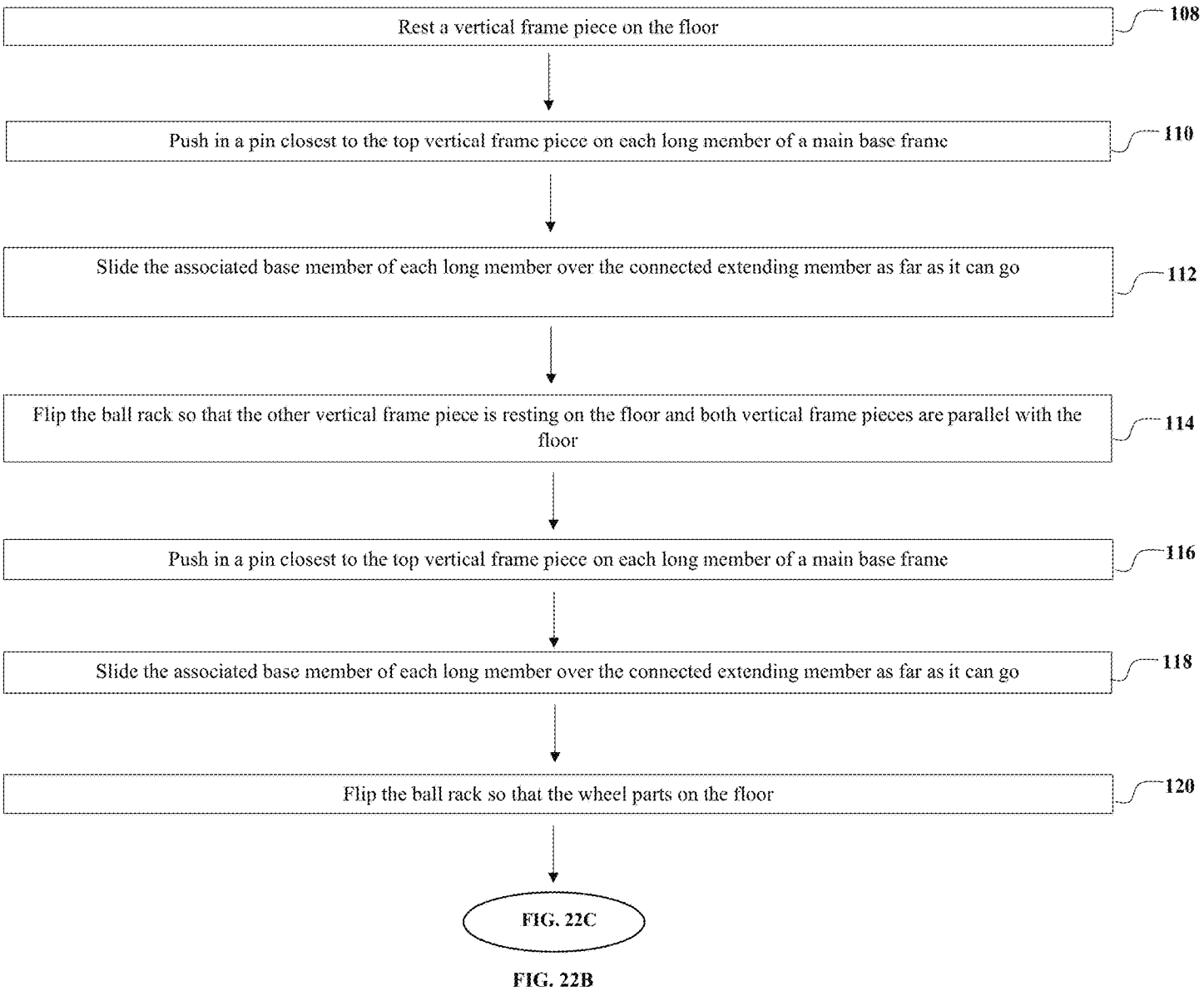
Figure 22C:
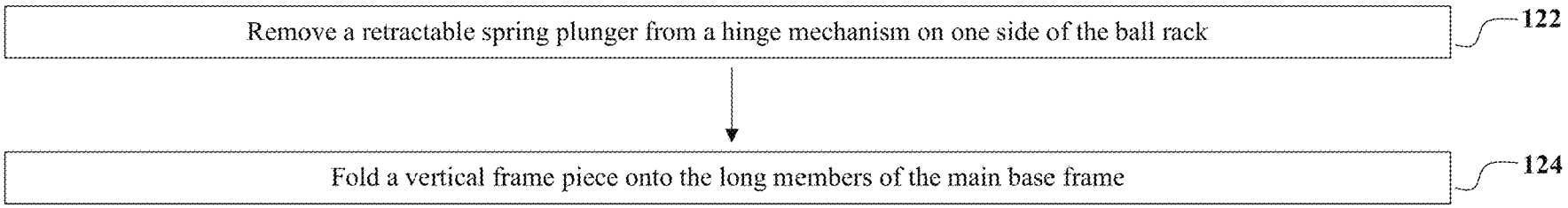
Figure 23A:
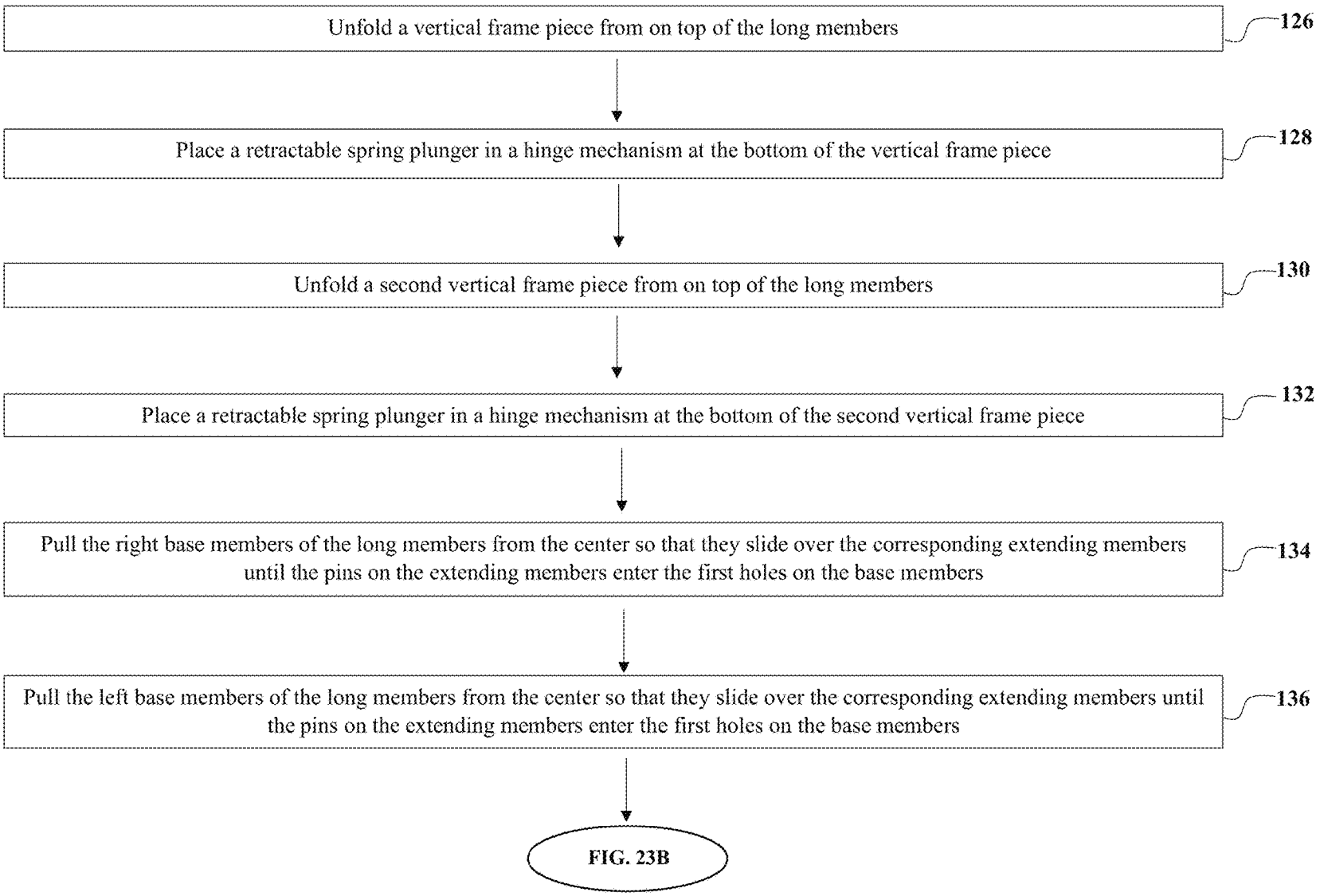
FIG. 23A-B is a flow chart displaying a method for unfolding the ball rack from a storable configuration into a 4-ball configuration.
Figure 23B:
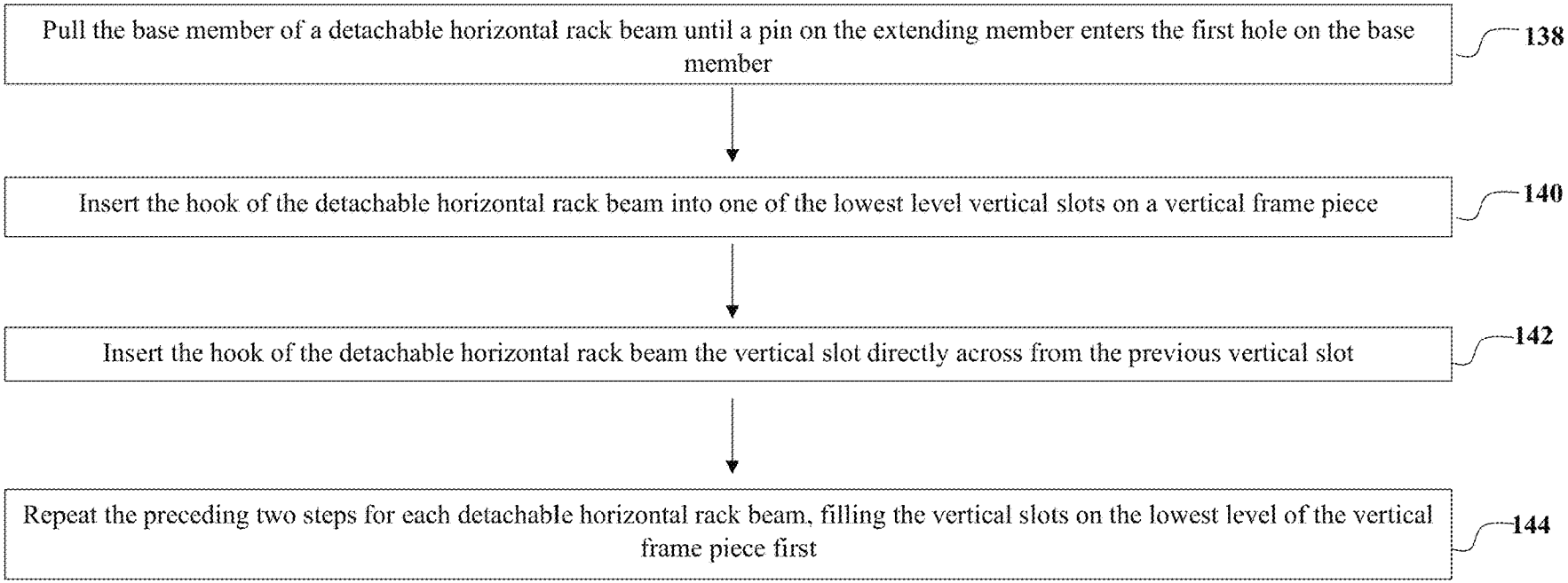
Figure 24A:
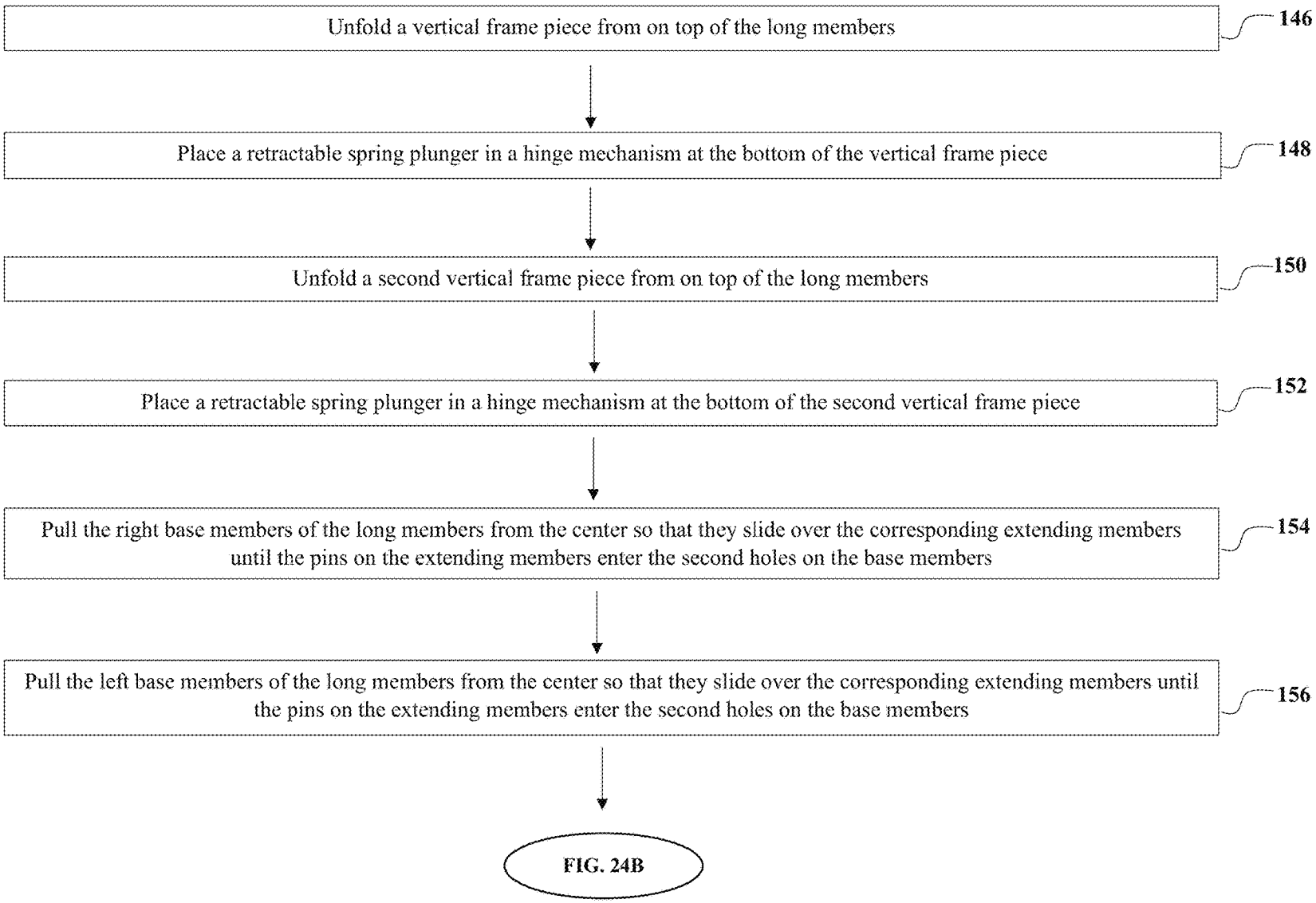
FIG. 24A-B is a flow chart displaying a method for unfolding the ball rack from a storable configuration into a 5-ball configuration.
Figure 24B:
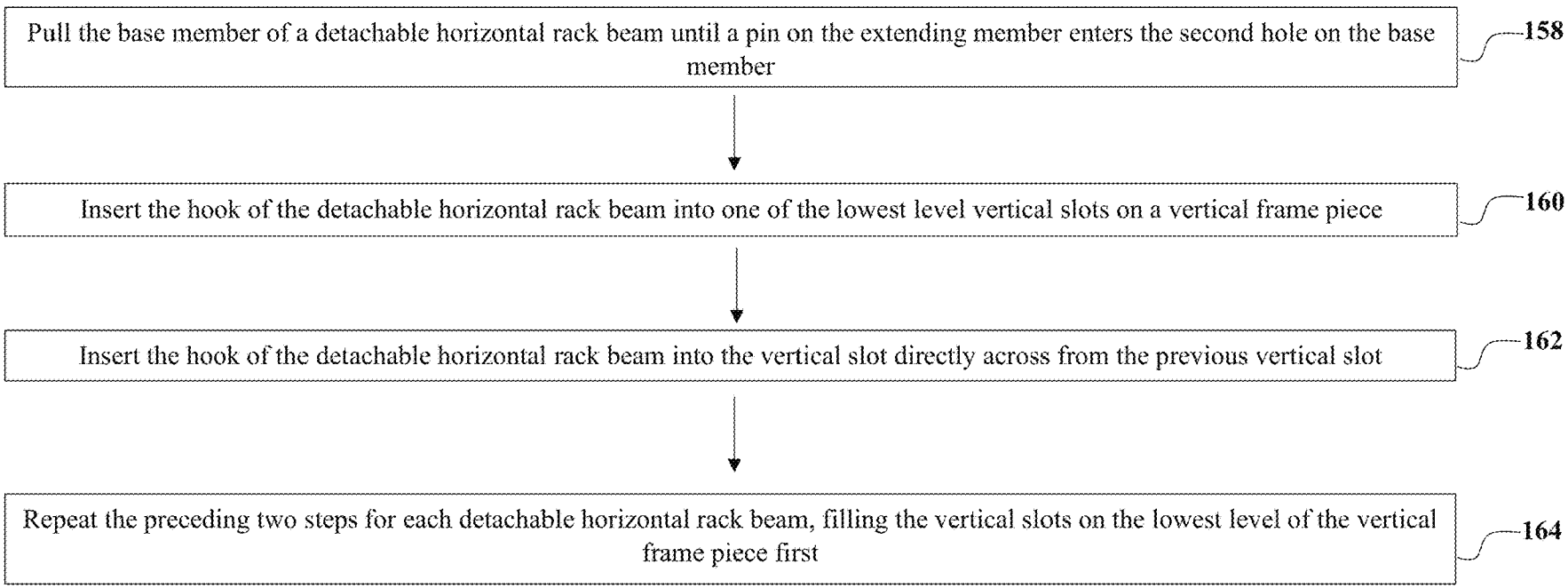

As shown in FIG. 19-20, the assembled ball rack 10 can take on various configurations. In FIG. 19, the ball rack 10 is in a 5-ball configuration. In this configuration, the ball rack 10 can hold a total of 15 balls, with 5 on each level. In FIG. 20, the ball rack 10 is in a 4-ball configuration. In this configuration, the ball rack 10 can hold a total of 12 balls, with 4 on each level. The assembled configuration is dependent on the width of the long members 14 and the detachable horizontal rack beams 26 determined with the corresponding pin and hole mechanism.

What is claimed is:

1. A ball rack comprising:

a main base frame, the main base frame comprised of:

a first set of members;

a second set of members having telescoping features to allow variation in width using a set of pin and hole mechanisms;

a set of wheeled accessories having bolts to attach each wheeled accessory to the first set of members;

a set of upright vertical frame bars connected to the main base frame at a 90-degree angle via a set of hinge mechanisms; and a set of detachable horizontal rack beams having a base member with an extending member on either end, which uses a telescoping mechanism to allow variation in width using a second set of pin and hole mechanisms, connected to the vertical upright frame bars via a set of hook and lock mechanisms, so that said rack is mobile between:

a storable configuration;

a portable configuration; and a ball-holding configuration; and wherein the upright vertical frame bars have the set of hinge mechanisms on a lower portion where the upright vertical frame bar meets the main base frame, the hinge mechanism comprising:

a hinge plate;

a female hollow section;

a hex head screw;

at least one blind rivet; and at least one retractable spring plunger.

2. The ball rack of claim 1 wherein the detachable horizontal rack beams have a hook at each end configured to fit into holes on the inward portion of the upright vertical frame bars.

3. The ball rack of claim 2 wherein the detachable horizontal rack beams are locked at a front and back of the ball rack in a symmetrical and parallel configuration, creating a uniform distance between the front and back.

4. The ball rack of claim 1 wherein the wheel accessories are detachably attached to the main base frame with a bolt, the wheel accessories comprising:

a wheel part, a bolt, and a bolt hole.

5. The ball rack of claim 1 wherein the wheel accessories are detachably attached to the main base frame with a wingnut, the wheel accessories comprising:

a wheel part, a wheel wingnut, a screw hole, and a screw.

6. A method for folding the ball rack of claim 1 into the storable configuration comprising:

pulling a detachable horizontal rack beam up to remove a hooks of the detachable horizontal rack beam from a vertical slots in the set of upright vertical frame bars;

pushing in pins on the detachable horizontal rack beam and sliding a base member over an extending member to shorten the detachable horizontal rack beam;

removing the detachable horizontal rack beam from in between the set of upright vertical frame bars;

repeating the preceding three steps for each detachable horizontal rack beam;

turning the ball rack on a side so that the set of upright vertical frame bars are parallel with the floor and the set of detachable horizontal rack beams are perpendicular with the floor;

pushing in a pin closest to the set of upright vertical frame bars furthest from the floor on each second member of the main base frame;

sliding the associated base member of each second member over the connected extending member;

turning the ball rack on another side so that the set of upright vertical frame bars are parallel with the floor and the set of detachable horizontal rack beams are perpendicular with the floor;

pushing in a pin closest to the set of upright vertical frame bars furthest from the floor on each long member of the main base frame;

sliding the associated base member of each second member over the connected extending member;

flipping the ball rack so that the wheel parts are on the floor;

removing a retractable spring plunger from a hinge mechanism on one side of the ball rack;

folding a first set of upright vertical frame bars onto the second members of the main base frame;

removing a retractable spring plunger from a hinge mechanism on another side of the ball rack; and folding a second set of upright vertical frame bars onto the already folded upright vertical frame bar.

7. A method for unfolding the ball rack from the storable configuration of claim 6 into a 4-ball configuration wherein each level of the ball rack can hold four balls:

unfolding the second set of upright vertical frame bars;

placing a retractable spring plunger in a hinge mechanism at the bottom of the first set of upright vertical frame bars;

unfolding the first set of upright vertical frame bars;

placing a retractable spring plunger in a hinge mechanism at the bottom of the first set of upright vertical frame bars;

pulling the associated base members of the second members from the center so that they slide over the corresponding extending members until the pins on the extending members enter the first holes on the base members;

pulling the base member of a detachable horizontal rack beam until a pin on the extending member enters the first hole on the base member;

inserting the hook of the detachable horizontal rack beam into a lowest level vertical slot on a set of upright vertical frame bars;

inserting the other hook of the detachable horizontal rack beam into the hole directly across from the lowest level vertical slot; and repeating the preceding two steps for each detachable horizontal rack beam.

8. A method for unfolding the ball rack of from the storable configuration of claim 6 into a 5-ball configuration wherein each level of the ball rack holds up to five balls:

unfolding the second set of upright vertical frame bars;

placing a retractable spring plunger in a hinge mechanism at the bottom of the first set of upright vertical frame bars;

unfolding the first set of upright vertical frame bars;

placing a retractable spring plunger in a hinge mechanism at the bottom of the first set of upright vertical frame bars;

pulling the associated base members of the second members from the center so that they slide over the corresponding extending members until the pins on the extending members enter the second holes on the base members;

pulling the base member of a detachable horizontal rack beam until a pin on the extending member enters the second hole on the base member;

inserting the hook of the detachable horizontal rack beam into the lowest level vertical slot on a set of upright vertical frame bars;

inserting the other hook of the detachable horizontal rack beam into the hole directly across from the lowest level vertical slot; and repeating the preceding two steps for each detachable horizontal rack beam.

9. A method for folding the ball rack of claim 1 into the portable configuration comprising:

pulling a detachable horizontal rack beam up to remove the hooks of the detachable horizontal rack beam from vertical slots in the set of upright vertical frame bars;

pushing in pins on the detachable horizontal rack beam and sliding a base member over an extending member to shorten the detachable horizontal rack beam;

removing the detachable horizontal rack beam from in between the set of upright vertical frame bars;

repeating the preceding three steps for each detachable horizontal rack beam;

turning the ball rack on a side so that the set of upright vertical frame bars are parallel with the floor and the set of detachable horizontal rack beams are perpendicular with the floor;

pushing in a pin closest to the set of upright vertical frame bars furthest from the floor on each long member of the main base frame;

sliding the associated base member of each second member over the connected extending member;

turning the ball rack on another side so that the set of upright vertical frame bars are parallel with the floor and the set of detachable horizontal rack beams are perpendicular with the floor;

pushing in a pin closest to the set of upright vertical frame bars furthest from the floor on each second member of a main base frame;

sliding the associated base member of each second member over the connected extending member as far as it can go;

flipping the ball rack so that the wheel parts are on the floor;

removing a retractable spring plunger from a hinge mechanism on one side of the ball rack; and folding one of the set of upright vertical frame bars onto the second members of the main base frame.

* * * * *